US005747413A

United States Patent [19]

Amano et al.

[11] Patent Number: 5,747,413

[45] Date of Patent: May 5, 1998

[54] REVERSIBLE THERMOSENSITIVE RECORDING MATERIAL AND METHOD OF FORMING AND ERASING IMAGES

[75] Inventors: Tetsuya Amano, Numazu; Yoshihiko Hotta, Mishima; Makoto Kawaguchi, Numazu; Kazumi Suzuki, Shizuoka-ken; Fumihito Masubuchi, Mishima, all of Japan

[73] Assignee: Ricoh Company, Ltd., Tokyo, Japan

[21] Appl. No.: 829,147

[22] Filed: Mar. 31, 1997

Related U.S. Application Data

[63] Continuation of Ser. No. 522,364, filed as PCT/JP95/00103, Jan. 27, 1995, abandoned.

[30] Foreign Application Priority Data

Jan. 28, 1994 [JP] Japan ..... 6-026177

[51] Int. Cl.[6] ..... B41M 5/36

[52] U.S. Cl. ..... 503/201; 503/207; 503/208

[58] Field of Search ..... 428/195, 913, 428/914; 503/201, 207, 208, 216, 217

[56] References Cited

FOREIGN PATENT DOCUMENTS 0 543264 5/1993 European Pat. Off. .
42 22 434 1/1993 Germany .

*Primary Examiner*—Bruce H. Hess
*Attorney, Agent, or Firm*—Oblon, Spivak, McClelland, Maier & Neustadt, P.C.

[57] ABSTRACT

A reversible thermosensitive recording material which includes a support, and a thermosensitive layer provided on the support and including, as main ingredients, a resin matrix and an organic low molecular weight substance dispersed in the resin matrix, wherein the transparency of the thermosensitive layer reversibly changes depending on the temperature thereof is characterized in that the rate of change in heating temperature for the initiation of transparentization is 13% or less, the rate of change in transparency is at least 50% or the rate of change in film thickness is at least 2%. By heating the reversible thermosensitive recording material, the formation and erasure of images may be suitably effected.

52 Claims, 11 Drawing Sheets

REVERSIBLE THERMOSENSITIVE RECORDING MATERIAL AND METHOD OF FORMING AND ERASING IMAGES

This application is a continuation of application Ser. No. 08/522,364, filed on Sep. 28, 1995, now abandoned, which was filed as International application No. PCT/JP95/00103 on Jan. 27, 1995.

BACKGROUND OF THE INVENTION

1. Technical Field

This invention relates to a reversible thermosensitive recording material which permits repeated formation and erasure of images by utilizing a reversible change in transparency of a thermosensitive layer thereof by a temperature change.

2. Background Art

Recently, an attention has been paid to a reversible thermosensitive recording material capable of temporarily recording images thereon and erasing same therefrom when such images become unnecessary. As representative examples of this kind of reversible thermosensitive recording material, there are conventionally known recording materials having a thermosensitive layer whose transparency reversibly changes depending upon the temperature and in which an organic low molecular weight material such as a higher fatty acid is dispersed in a matrix resin such as vinyl chloride-vinyl acetate copolymer (JP-A-54-119377 and JP-A-55-154198). The known recording materials, however, have a defect that the temperature range in which the thermosensitive layer is transparent and transmits light is as narrow as 2°–4° C., so that it is difficult to control the temperature for the formation of images utilizing the light transmittance-transparency and light blocking-white opaqueness thereof.

In view of the above problem, JP-A-63-39378 proposes the use of a mixture of a higher fatty acid with a fatty acid ester as the organic low molecular weight material so as to broaden the temperature range where the thermosensitive layer is transparent. The temperature range where this recording material is transparent is, however, only about 10° C. Thus, it is not possible to completely erase (transparentize) an image with a thermal head, though the image can be erased (transparentized) by heating for a relatively long time with a reheating roller or a hot plate.

The present inventors proposed to use a mixture of a higher fatty acid with an aliphatic saturated dicarboxylic acid (JP-A-2-1363 and JP-A-3-2089). By this technique, the temperature range where the recording material is transparent is broadened to about 20° C. so that the erasure (transparentization) of images can be performed by heating with a thermal head. However, the erasure is not satisfactory when the heating time of the thermal head is short.

The present inventors further proposed the use of three or more organic low molecular weight materials having different melting points (JP-A-5-294066). By this expedient, the temperature range in which the recording material is transparent is broadened to about 30° C. so that the erasure (transparentization) can be made by application of a thermal energy for a short time with a thermal head. But, erasure characteristics are not fully satisfactory.

When a white opaque image is stored for a long period of time, the erasure characteristics often change so that the erasure of the image under conditions suitable in the early stage of the storage becomes incomplete. In view of this problem, the present inventors have proposed to use a matrix resin for a thermosensitive layer which resin has a degree of polymerization of at least 1,000 and a weight ratio of vinyl chloride units to vinyl acetate units of 90:10 to 60:40 (JP-A-5-169810). By this expedient, the erasability of white opaque images upon storage may be improved. In this case, however, while the erasability after 24 hours storage is satisfactory, a longer storage time causes incomplete erasure. Further, there is encountered a defect that erasability after storage at a relatively higher temperature of 40° C. is worse than that at a relatively low temperature of 5°–23° C.

To improve the erasability after lapse of time, there is proposed a recording device in which the erasure is performed after correcting the erasure energy on the basis of the time lapsed after the formation of the white opaque images (JP-A-5-155107). As described above, however, the erasing characteristics vary with a change of the environmental temperature. Thus, while the erasure may be performed in a stable manner by correcting the erasing energy when the storage temperature is constant, the erasability of images becomes incomplete due to a change in the environmental temperature when the energy correction is made in a fixed manner based only on the lapse of time.

It is, therefore, an object of the present invention to provide a reversible thermosensitive recording material which has an improved high speed erasability, which can prevent a change of erasability with time and which has excellent durability in repeated use.

Another object of the present invention is to provide a method of forming and erasing images which does not require fine control of a thermal head for forming and erasing the images and which can ensure high speed formation and erasure of images.

DISCLOSURE OF THE INVENTION

The present invention provides a reversible thermosensitive recording material comprising a support, and a thermosensitive layer provided on said support and including, as main ingredients, a resin matrix and an organic low molecular weight substance dispersed in said resin matrix, wherein the transparency of said thermosensitive layer reversibly changes depending on the temperature thereof, characterized in that said reversible thermosensitive recording material has a rate of change in heating temperature for the initiation of transparentization of 13% or less.

The present invention also provides a reversible thermosensitive recording material comprising a support, and a thermosensitive layer provided on said support and including, as main ingredients, a resin matrix and an organic low molecular weight substance dispersed in said resin matrix, wherein the transparency of said thermosensitive layer reversibly changes depending on the temperature thereof, characterized in that said thermosensitive layer has a rate of change in transparency of at least 50%.

The present invention further provides a reversible thermosensitive recording material comprising a support, and a thermosensitive layer provided on said support and including, as main ingredients, a resin matrix and an organic low molecular weight substance dispersed in said resin matrix, wherein the transparency of said thermosensitive layer reversibly changes depending on the temperature thereof, characterized in that said thermosensitive layer has a rate of change in film thickness of at least 2%

The present invention further provides a method of forming and erasing an image on a reversible thermosensitive recording material which has a rate of change in heating temperature for the initiation of transparentization of 13% or less and which includes a support, and a thermosensitive layer provided on said support and including, as main ingredients, a resin matrix and an organic low molecular weight substance dispersed in said resin matrix, wherein the transparency of said thermosensitive layer reversibly changes depending on the temperature thereof, characterized in that the formation of a white opaque image and/or the erasure of the white opaque image is carried out by heating.

The present invention further provides a method of forming and erasing an image on a reversible thermosensitive recording material which has a rate of change in film thickness of at least 2% and which includes a support, and a thermosensitive layer provided on said support and including, as main ingredients, a resin matrix and an organic low molecular weight substance dispersed in said resin matrix, wherein the transparency of said thermosensitive layer reversibly changes depending on the temperature thereof, characterized in that the formation of a white opaque image and/or for the erasure of the white opaque image is carried out by heating.

BRIEF DESCRIPTION OF THE DRAWINGS

FIG. 14(*b*) is a diagram showing a wave form of the intensity of transmitted light outputted from a printer of a digital oscilloscope of a thermosensitive layer film obtained in Comparative Example 1.

BEST MODE FOR PRACTICING THE INVENTION

The present invention will be further illustrated in detail below.

The mechanism of the change of the reversible thermosensitive recording material between white opaqueness and transparency according to the present invention is considered to be as follows.

The mechanism is based on the facts (I) that, in the transparent state, the particles of an organic low molecular weight material dispersed in a resin matrix is in close contact with the resin matrix without any space therebetween and without any space within the particles, so that incident light from one side can be transmitted out of the other side without being scattered, thereby being seen to be transparent; and (II) that, in the white opaque state, there are formed interstices at the interface between the fine crystals of the organic low molecular weight material particles and at the interface between the particles and the matrix resin, so that incident light from one side is reflected on the interfaces between the space and the crystals and between the space and the resin and, thus, scattered, thereby being seen to be white.

Figure 1:
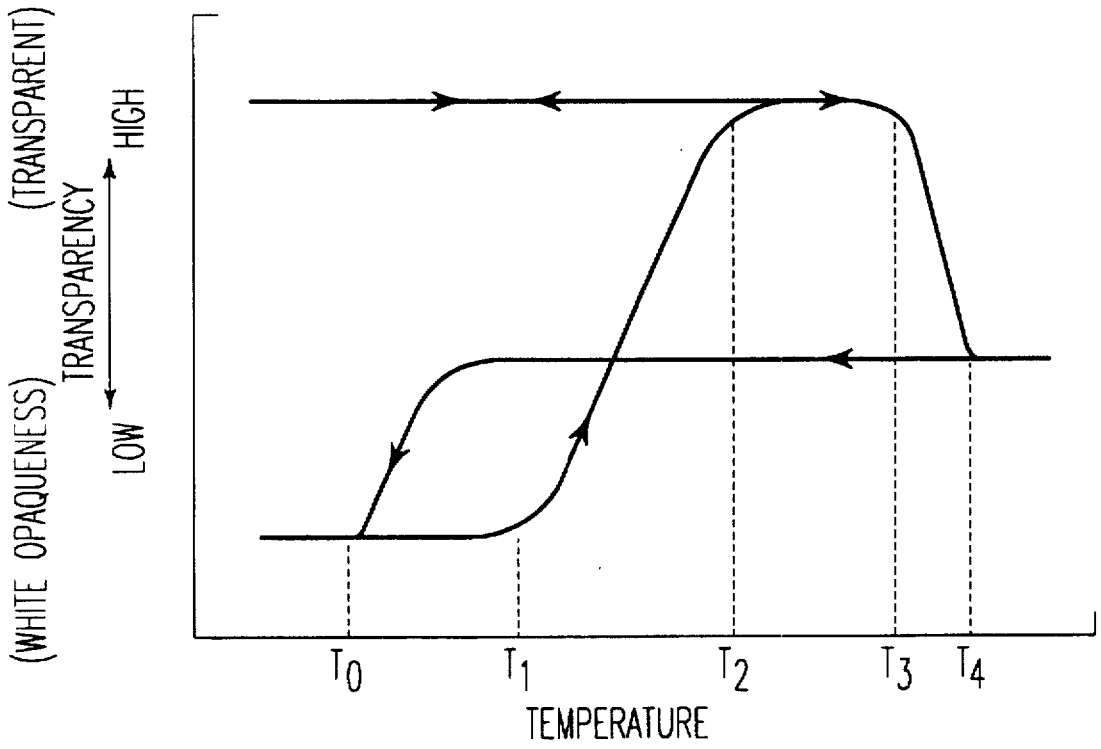
FIG. 1 is a diagram showing the temperature dependency of transparency on the temperature of a thermosensitive layer according to the present invention.

Referring to FIG. 1, showing the change of transparency by heating, a thermosensitive layer including, as main ingredients, a resin matrix and an organic low molecular weight substance dispersed in the resin matrix is in a white opaque state at an ambient temperature of $T_o$ or below.

Upon being heated, the thermosensitive layer at a temperature $T_1$ begins becoming gradually transparent and becomes completely transparent at $T_2$–$T_3$. When cooled to ambient temperature below To as such, the layer remains transparent. The above phenomenon may be explained as follows. As the temperature is increased to $T_1$, the resin begins softening. As the softening proceeds, the resin fills the space between the resin and the particles of the organic low molecular weight material and between the adjacent particles, so that the transparency increases. At a temperature of $T_2$–$T_3$, the organic low molecular weight material partly melts so that the remaining space is filled therewith, whereby the layer becomes transparent. When the layer is cooled as such, the organic low molecular weight material is crystallized at a relatively high temperature because of the presence of seed crystals. In this case, since the resin still remains in a softened state, the resin can follow the volume changes caused by the crystallization of the organic low molecular weight material, so that no space is formed, i.e. the layer is maintained transparent upon being cooled.

On the other hand, the layer, when heated to a temperature $T_4$ or more, becomes translucent between the maximum transparency and the maximum opaqueness. When the temperature is then lowered, the layer returns to the original white opaque state rather than the transparent state. This phenomenon may be explained as follows. At a temperature of $T_4$ or more, the low molecular weight material is completely melted. When the temperature is then lowered, the low molecular weight material is crystallized at a temperature slightly higher than $T_o$ under a supercooled state. In this case, the resin which is no longer in the softened state cannot follow the volume change of the low molecular weight material caused by the crystallization thereof, so that there is formed space.

The temperature-transparency curve shown in FIG. 1 represents a typical example and the transparency will vary when the materials used are changed.

The softening point of the resin and the behavior of the resin above the softening point play an important role in the change in transparency. To improve the high speed erasability, it is considered to be necessary to enlarge the range of the transparentizing temperature, i.e. the range of $T_2$–$T_3$ in FIG. 1, and to enhance the deformation speed of the resin above the softening point thereof.

The transparentization is caused by the softening of the resin. The fact that the heating temperature for the initiation of transparentization depends on the heating time (namely, the heating temperature for the initiation of transparentization is increased or decreased by an increase or decrease of the heating time) indicates that the softening of the resin depends on the heating time (namely, the resin is easily softened when the heating time is long but is hardly softened when the heating time is short). On the other hand, the fact that the heating temperature for the initiation of transparentization does not depend on the heating time indicates that the resin can be softened within a short period of time.

Accordingly, the fact that the rate of change of the heating temperature for the initiation of transparentization by the heating time is low indicates that the resin can be softened within a short period of time. Namely, the space can be easily reduced by the deformation of the resin so that the transparentization is effected within a short period of heating and the erasure can be performed at a high speed.

Thus, to attain the above effect, the rate of change of heating temperature for the initiation of transparentization is 13% or less, preferably 10% or less, more preferably 6% or less.

The rate of change of the heating temperature for the initiation of transparentization is measured according to the following method using a heat gradation tester HG-100 manufactured by Toyo Seiki Manufacturing Co., Ltd.

The conditions under which the heating temperature for the initiation of transparentization is measured include a printing time of 60 seconds set in a printing timer of the tester and a printing pressure of 1 kg/cm$^2$ which is indicated on a pressure gauge. Under the above conditions, a reversible thermosensitive medium which is in a white opaque state is heated for 60 seconds at various temperatures increasing by 1° C. from 50° C. The medium thus heated at each of the various temperatures is then measured by Macbeath densitometer (RD-914) for the reflection density thereof. The minimum heating temperature above which the reflection density exceeds the value which is smaller by 0.2 (O. D.) than that of the background represents the heating temperature for the initiation of transparentization ($T_{60s}$) at a heating time of 60 seconds.

The printing timer is then set to 1 second and the above measurement is repeated. The minimum heating temperature under these conditions represents the heating temperature for the initiation of transparentization ($T_{1S}$) at a heating time of 1 second. Incidentally, the background density is an average of the reflection densities in 10 portions of a reversible thermosensitive material which has been made most transparent by being heated at an arbitrary temperature using a constant temperature oven. The rate of change of the heating temperature for the initiation of transparentization is given by the following equation:

Rate of change of heating temperature for the initiation of transparentization (%)

$$=[(|T_{1s}-T_{60s}|)/T_{60S}]\times 100$$

$T_{1s}$: Heating temperature for the initiation of transparentization with a heating time of 1 second (°C.)

$T_{60S}$: Heating temperature for the initiation of transparentization with a heating time of 60 seconds (°C.)

In the measurement of the rate of change of the heating temperature for the initiation of transparentization, it is possible to change the pressure and temperature when the above described conditions are insufficient to effect transparentization. The above method for the measurement of the heating temperature for the initiation of transparentization may be applied to both types of the previously described reversible thermosensitive recording materials (1) having only a recording layer (thermosensitive layer) and (2) having a protecting layer.

As described previously, the change of the reversible thermosensitive recording material of the present invention from the white opaque state to the transparent state is caused by the reduction of space due to softening and shrinkage of the resin. The fact that the transparentization is caused by a short period of heating in the order of several milliseconds indicates that the resin is abruptly softened, i.e. the deformation speed of the resin is not good.

Namely, the fact that the transmittance is greatly changed, by heating for a short period in the order of milliseconds, from the white opaque state to the transparent state indicates that the deformation speed of the resin is so fast that the reduction of the space, namely transparentization, proceeds at a high speed, thereby to reduce the erasing time as a whole.

To achieve the above effect, the rate of change in transparency is 50% or more, preferably 60% or more, more preferably 70% or more.

Figure 2:
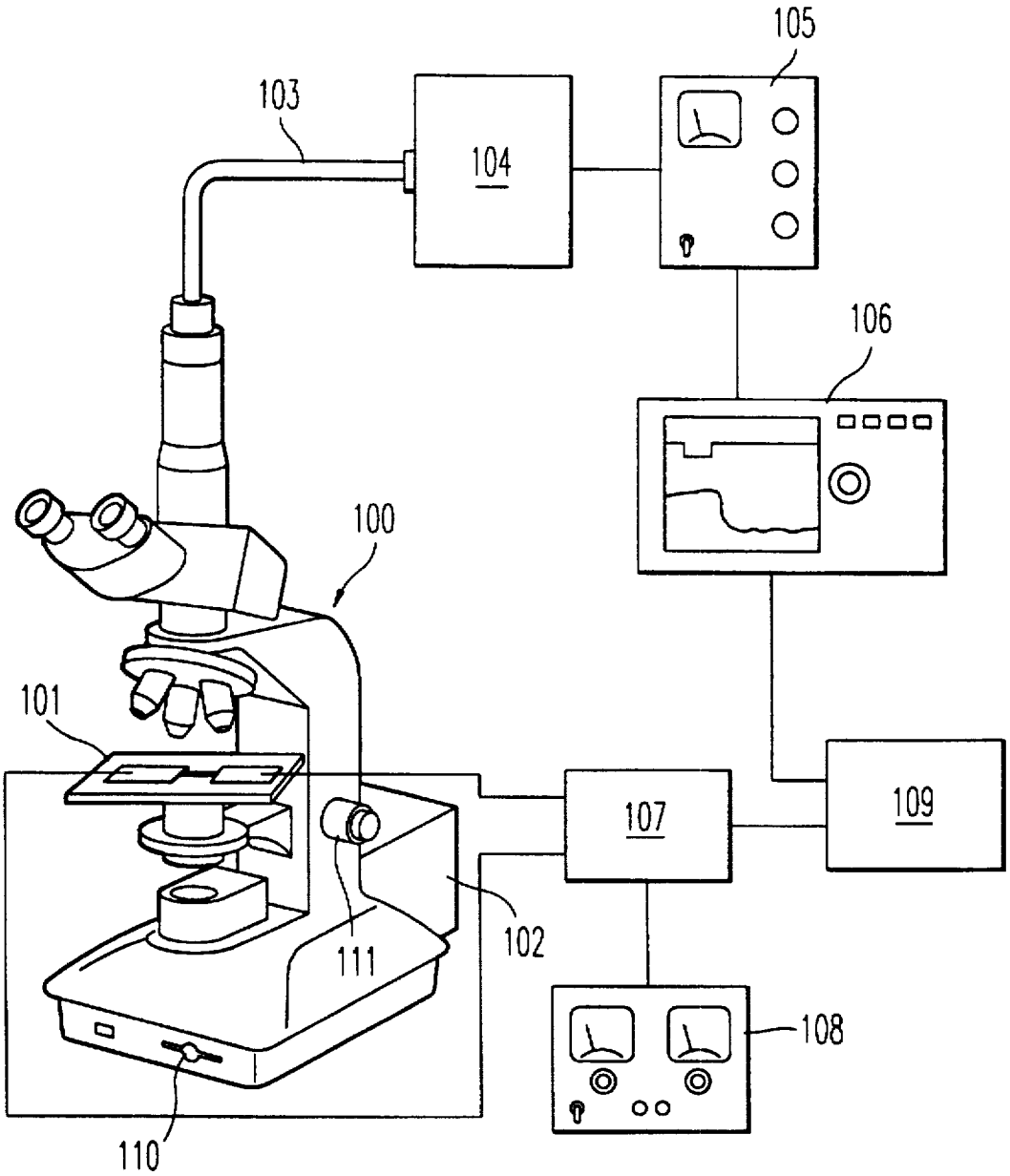
FIG. 2 is a schematic illustration of a device for measuring the rate of change in transparency.

The rate of change in transparency is measured by the following method using a device as shown in FIG. 2.

As shown in FIG. 2, the device for measuring the rate of change in transparency is composed of an optical microscope 100 (OPTIPFOT 2-POL manufactured by Nicon Inc.) having a light source and a transmitted light condensing section, an optical fiber 103 serving as a transmitted light detecting section, a photomultimeter 104, an amplifier 105, a digital oscilloscope 106, a switch box 107 serving as a heating controller section, a DC power source 108, a personal computer 109 and an ITO/Al support 101 serving as a heating section. It is without saying that the switch box is electrically connected by lead wires with electrodes of the ITO/Al support 101.

Figure 3:
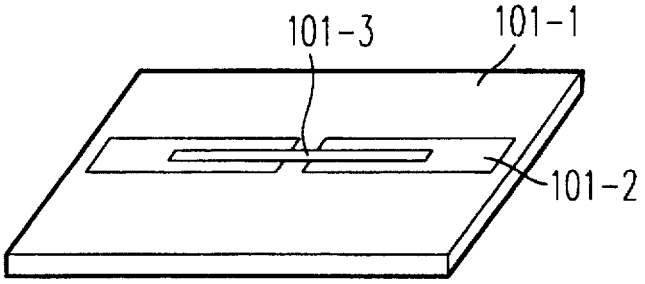
FIG. 3 is an enlarged perspective view of ITO/Al support.

As shown in FIG. 3, the ITO/Al support 101 includes a heat resistant glass 101-1, a heat generating element 101-3 of an ITO film (film thickness: about 2,500Å) provided by sputtering on the support, and electrodes 101-2 of Al (film thickness: about 1.2 μm) formed on the element. As the light source 102, there is used a DC halogen lamp to which an electric current is supplied from the DC power source (not shown). Further, a printer is accommodated in the digital oscilloscope 106 so that the change in transparency may be not only determined by display but also outputted to the printer.

To measure the change in transparency, a thermosensitive layer of any desired thickness is first formed on a support. The resulting reversible thermosensitive recording material is then heated and cooled to provide the maximum white opaqueness and the maximum transparency. The thermosensitive layer is peeled off from the support to obtain two kinds of thermosensitive films in the white opaque state and in the transparent state.

Then, the optical microscope 100 is set so that the object glass has a magnification of 4. The position of the heat generating element (area: 1 $mm^2$) 101-3 shown in FIG. 3 is adjusted so that the element is in the field of the view. Then, the object glass having a magnification of 10 is selected and the position of the ITO/Al support is adjusted so that the heat generating element occupies the field of the view.

Figure 4:
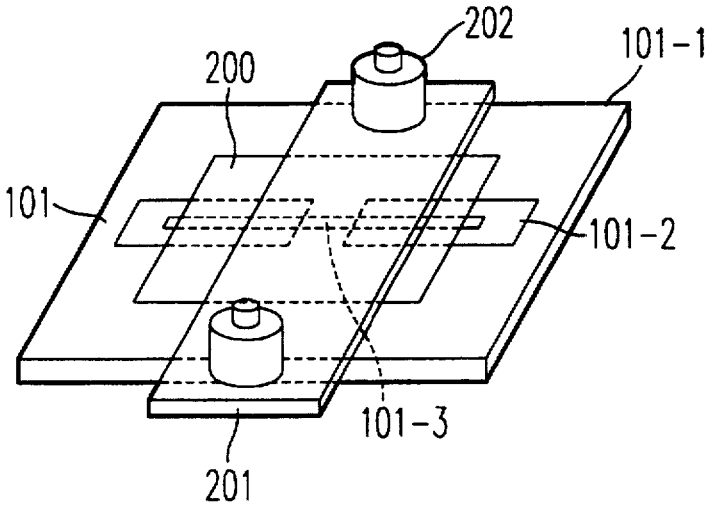
FIG. 4 is a schematic illustration of a device for measuring the transparency of a thermosensitive layer film.

Subsequently, as shown in FIG. 4, the thermosensitive film 200 in the transparent state is placed on the ITO/Al support 101 and is overlaid with a slide glass 201. Weights 202 are placed on the glass 201. After assembly, the transparency is measured in the following manner.

First, the transmitted light intensity is controlled with a light control 110 shown in FIG. 2. At the same time, the transmitted light detector section is adjusted by the photomultimeter 104, amplifier 105 and digital oscilloscope 106, so that a wave form indicative of the transmitted light intensity is shown at a position slightly lower than the center of the display by the digital oscilloscope. The value of the Y-coordinate of the wave form, which represents a transmitted light intensity in static transparency ($V_{ST}$), is read out. Here, the X-coordinate of the digital oscilloscope represents the time (millisecond), whereas the Y-coordinate represents the voltage (mV).

The above procedure is repeated in the same manner as described except that the thermosensitive film in the transparent state on the ITO/Al support is replaced by the thermosensitive film in the white opaque state. Thus, the value in the Y-coordinate, which represents a transmitted light intensity in static white opaqueness ($V_{SW}$), is read out.

While maintaining the above state where the thermosensitive film in the white opaque state is mounted on the support and while maintaining the other conditions unchanged, the power source of the switch box in FIG. 2 is ON. The voltage of the power source 108 is adjusted and the pulse width of the personal computer is set at 2 milliseconds, so that the heat generating element on the ITO/Al support 101 is actuated with a pulse width of 2 milliseconds. In synchronism with the heat generation of the heat generating element, the intensity of the transmitted light at the time the white opaque state is changed to the transparent state is inputted to the digital oscilloscope and is outputted from the display and the printer.

From the outputted wave forms, the transmitted light intensities in the white opaque state and in the transparent state are read out. Then, the position of the thermosensitive film is adjusted in the manner described previously and the above-mentioned voltage is changed. Thereafter, the measurement is conducted in the same manner as above. The transmitted light intensities in the white opaque state and in the transparent state that give the maximum difference therebetween represent the transmitted light intensity in dynamic white opaqueness ($V_{DW}$) and the transmitted light intensity in dynamic transparency ($V_{DT}$), respectively. In this case, it should be confirmed with eyes that the heated portion becomes transparent.

From the thus obtained intensities of the transmitted light $V_{SW}$, $V_{ST}$, $V_{DW}$ and $V_{DT}$, the rate of change in transparency is obtained according to the following equation:

$$C_T(\%)=[(V_{DW}-V_{DT})/(V_{SW}-V_{ST})]\times 100$$

$C_T$: rate of change in transparency (%)

$V_{SW}$: transmitted light intensity in static white opaqueness (mV)

$V_{ST}$: transmitted light intensity in static transparency (mV)

$V_{DW}$: transmitted light intensity in dynamic white opaqueness (mV)

$V_{DT}$: transmitted light intensity in dynamic transparency (mV)

The foregoing method for the measurement of the transparency may be applied to both types of the previously described reversible thermosensitive recording materials of the present invention (1) having only a recording layer and (2) having a protecting layer. When the support is transparent, it is possible to measure the transparency without peeling the thermosensitive layer off from the support.

As described previously, the change of the reversible thermosensitive recording material according to the present invention from a white opaque state to a transparent state is caused by the reduction of space due to the softening and shrinkage of the resin. Thus, a change from a white opaque state to a transparent state is accompanied with a reduction of the volume corresponding to the decrease of the space. When the thermosensitive layer is formed on a support, this volume change results in a change in the thickness direction rather than in a change in the direction parallel with the surface of the support.

Thus, the fact that the transmittance is greatly changed from a white opaque state to a transparent state upon heating for a short period of time in the order of millisecond indicates that the thickness of the thermosensitive layer is abruptly changed. Namely, when the resin is deformed quickly, the reduction of space, i.e. the transparentization, proceeds at a high speed, so that the erasure time may be shortened.

To achieve this effect, the rate of change in film thickness is 2.0% or more, preferably 3% or more, more preferably 4% or more.

The rate of change in film thickness is measured by the following method.

In measurement, the reversible thermosensitive recording materials used in the above-described measurement of the rate of change in transparency is used. The material is heated in a constant temperature oven so as to obtain the maximum white opaqueness of the thermosensitive layer and, then, cooled to obtain a recording medium having the maximum white opaqueness.

Next, marks are given at 10 arbitrary points of the surface of the support of the recording material. The thickness of the material is then measured at those 10 marked points with a digital electronic micrometer K351 manufactured by Anritsu Corporation. The average thickness represents a film thickness in the white opaque state ($R_W$).

The recording material is then heated in the constant temperature oven and cooled so as to obtain the maximum transparency. The thickness measurement is carried out in the same manner as above and the average is calculated to obtain a film thickness in the transparent state ($R_T$). From these thickness $R_W$ and $R_T$ and the transparency changing rate $C_T$ (%), the rate of change in film thickness is given according to the following equation:

$$\textit{Rate of change in film thickness}\ (\%)=[(R_W-R_T)\ (C_T/100)/R_W]\times 100$$

$R_W$: film thickness in the white opaque state (μm)

$R_T$: film thickness in the transparent state (μm)

$C_T$: rate of change in transparency (%)

The measurement of the film thickness may be performed using a laser displacement gauge of a non-contact type. The foregoing method for the measurement of the rate of change in film thickness may be applied to both types of the previously described reversible thermosensitive recording materials of the present invention (1) having only a recording layer and (2) having a protecting layer.

In the present invention, the terms "level difference caused by heat and pressure" and "rate of change in level difference by heat and pressure" of a thermosensitive layer serving as an image forming section of a reversible thermosensitive recording material are defined as follows.

The term "level difference caused by heat and pressure" represents a physical property showing the hardness of a coated layer under a heated state. The smaller of the level difference, the harder is the coated layer.

When the level difference caused by heat and pressure is 40% or less, the durability against repeated image formation and erasure with a thermal head or the like is significantly improved. The reason for this is considered to be that a force which inhibits the aggregation and expansion of the particles of the organic low molecular weight material by the contact of the particles with each other is suddenly increased so that the deformation of the thermosensitive layer upon application of heat and pressure with a thermal head or the like is minimized.

The level difference caused by heat and pressure is measured by the following method.

Figure 5A:
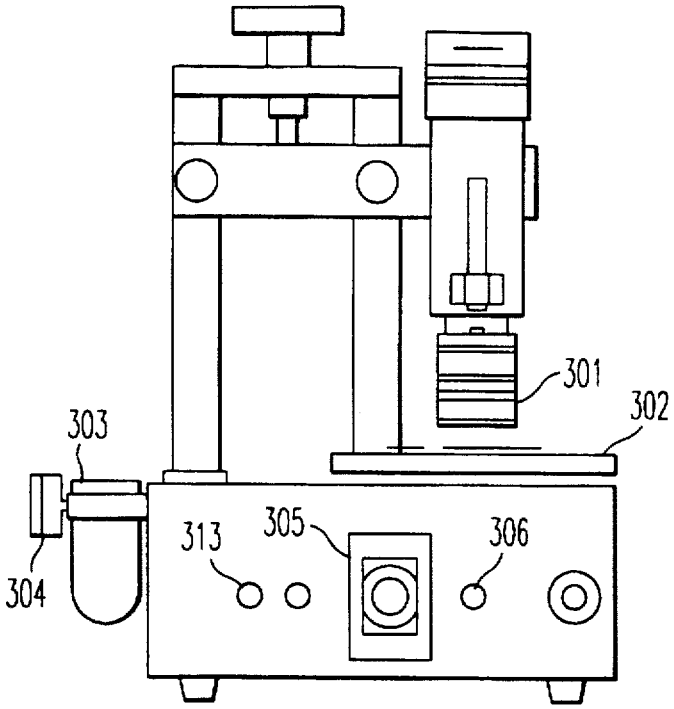
FIG. 5 is an illustration of a test machine of a hot stamp-type air-type table TC film erasing device (manufactured by Unique Machinery Inc.) used as a heat and pressure application device, FIGS. 5(*a*)–5(*b*) being a schematic elevational view, a schematic side view and a schematic view of a temperature controlling section, respectively, of the device.
Figure 5C:
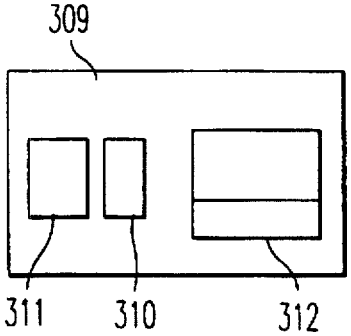
Figure 5B:
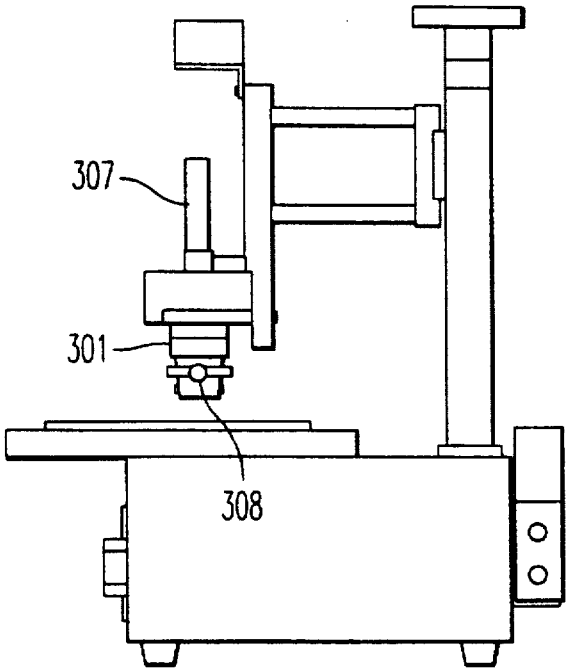

As a device for applying heat and pressure, a hot stamp-type air-type table TC film erasing device (manufactured by Unique Machinery Inc.) as illustrated in FIG. 5 is used. FIGS. 5(*a*)–5(*b*) are a schematic elevational view of the heat and pressure applying device, a schematic side view and a schematic view of a temperature controlling section thereof, respectively.

Figure 6A:
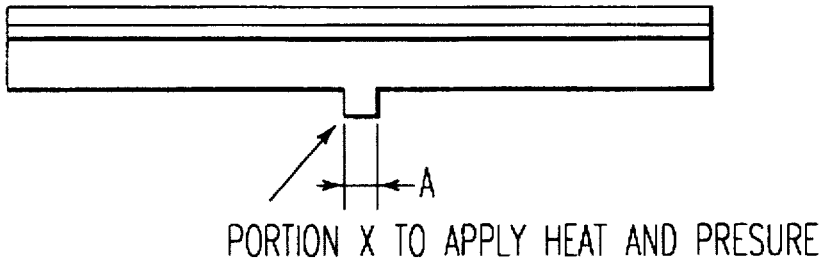
FIG. 6 illustrate a printing head of the device of FIG. 5, FIGS. 5(*a*) and 5(*b*) being an elevational view and a side view, respectively.
Figure 6B:
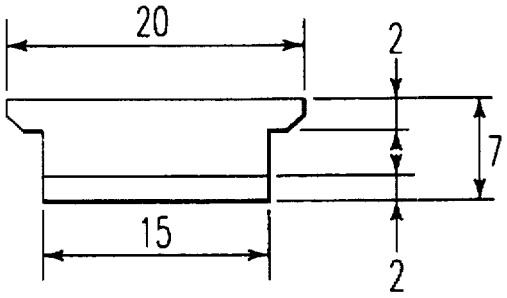

As shown in FIGS. 5(*a*) and 5(*b*), the heat and pressure applying device is composed of an air regulator 303, serving as a pressure adjusting section, a printing timer 305 serving as a time adjusting section, a temperature controlling device 312 serving as a temperature adjusting section, a printing head 301 serving as a heat and pressure applying section, and a sample support 302 for supporting a recording material thereon. The printing head 301 is specifically improved for the measurement of the level difference as shown in FIG. 6.

Figure 7:
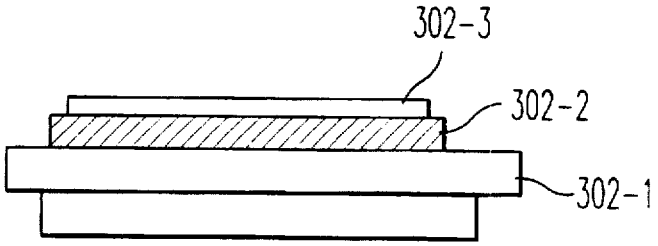
FIG. 7 illustrate a sample support for use with the heat and pressure application device of FIG. 5.

The printing head is formed of aluminum. That portion of a protruded portion X (FIG. 6) which is brought into contact with a surface of the thermosensitive layer has such surface characteristics involving a surface roughness (Ry) of 0.8 μm or less (according to JIS B0031-1982, B0601-1994) and an area of 0.225 $cm^2$. To prevent the dispersion of the pressure applied, the support 302 in FIG. 5 includes, as shown in FIG. 7, an aluminum plate 302-1, a fluoro-rubber 303-2 (spring hardness Hs: 65) having a thickness of 1 mm bonded on the plate, and a stainless steel plate 302-3 having a thickness of 1 mm and placed on the rubber.

The measurement of the level difference caused by heat and pressure is performed under the following conditions using the device shown in FIG. 5. The pressure applied is adjusted with the air regulator 303 such that the pressure value in the air gauge 304 is 2.5 $kg/cm^2$. Next, the printing time is adjusted at 10 seconds with the timer 305. Then the heating temperature is adjusted at 130° C. with the temperature controlling device 312. The heating temperature is the value which is subjected to the control of the heater 308 and the temperature sensor and is approximately the same as the temperature at the surface of the printing head.

The level difference caused by heat and pressure is measured by the following method using the above device.

Figure 8:
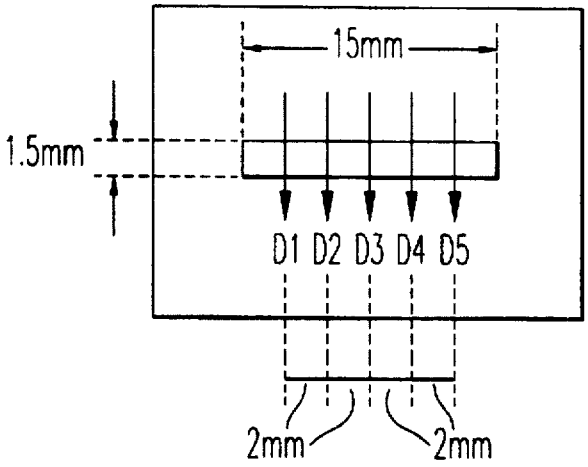
FIG. 8 is an enlarged view of a portion to which heat and pressure have been applied with the heat and pressure application device of FIG. 1.

A two-dimensional roughness analyzing device SURFCODER AY-41, a recorder RA-60E and SURFCODER SE30K manufactured by Kosaka Institute Inc. are used. First, SURFCODER SE30K is set at a vertical magnification (V) of 2,000 and a lateral magnification (H) of 20. Then, SURFCODER AY-41 is set at a standard length (L) of 5 mm and a feed rate (Ds) of 0.1 mm/sec. The results of the measurement is recorded by the recorder RA-60E. From a chart recorded, the level difference (Dx) is read out. The above setting values represent an example and may be varied as desired. As shown in FIG. 8, the measurement is carried out at five points $D_1$–$D_5$ spaced apart a distance of 2 mm along the widthwise direction of the heat and pressure applying section 301-1. An average of the five measured values represents an average level difference $D_M$.

From the average level difference $D_M$ and a thickness of the thermosensitive recording layer $D_B$, the level difference D is obtained according to the following equation:

$$D(\%)=[D_M/D_B]\times 100$$

D: level difference caused by application of heat and pressure (%)

$D_M$: average level difference (μm)

$D_B$: thickness of the thermosensitive recording layer

The thickness of the thermosensitive recording layer $D_B$ formed on a support may be determined by the analysis of the cross-section thereof with a transmission electron microscope (TEM) or a scanning electron microscope (SWEM).

The rate of change of the level difference caused by application of heat and pressure is a property showing a change of the hardness of the coated layer upon lapse of time. The smaller the rate of change, the better the stability of the coated layer. When the rate of change of the level difference is 70% or less, the effect of the present invention is significant, because this value is critical so that the stability in the thermal properties of the coated layer is significantly improved. The rate of change in level difference is given by the following equation:

$$Dc(\%)=[|(D_I-D_D)/D_I|]\times 100$$

$D_C$: rate of change in level difference caused by application of heat and pressure (%)

$D_I$: initial level difference caused by application of heat and pressure (%)

$D_D$: deferred level difference caused by application of heat and pressure (%)

The initial level difference $D_I$ is the value first measured after the formation of an image. It is not necessary that measurement of the initial level difference be carried out immediately after the formation of the image.

The deferred level difference $D_D$ is the value measured after holding a sample, similar to that used in the measurement of the initial level difference, at 50° C. for 24 hours. It is without saying that the initial and deferred level differences are measured and calculated according to the above-described method. When no level difference is caused with the above conditions (2.5 $kg/cm^2$, 130° C.) in the measurement of the rate of change in level difference caused by application of heat and pressure, it is possible to raise the pressure and temperature.

The foregoing method for the measurement of the level difference may be applied to both types of the previously described reversible thermosensitive recording materials of the present invention (1) having only a recording layer and (2) having a protecting layer.

The thermosensitive recording material according to the present invention may have a layer structure, as shown in Japanese Utility Model Laid Open Publication No. 2-3876, in which a thermosensitive layer and a magnetic recording layer containing a magnetic material as a main ingredient are provided on a support and in which at least that portion immediately below the thermosensitive recording layer or that portion of the support corresponding to the thermosensitive recording layer is colored. Alternatively, as shown in JP-A-3-130188, a layer structure may be adopted in which a magnetic recording layer, a light reflection layer and a thermosensitive layer are superimposed in this order on a support. In this case, the magnetic recording layer may be provided on a backside surface of the support or between the support and the thermosensitive recording layer. Other layer structures may be adopted, if desired.

The measurement of the level difference may be carried out without any problem when the thermosensitive recording material has any of the above layer structures. With such a thermosensitive recording material, heat and pressure are applied to a surface of the thermosensitive layer.

Figure 9:
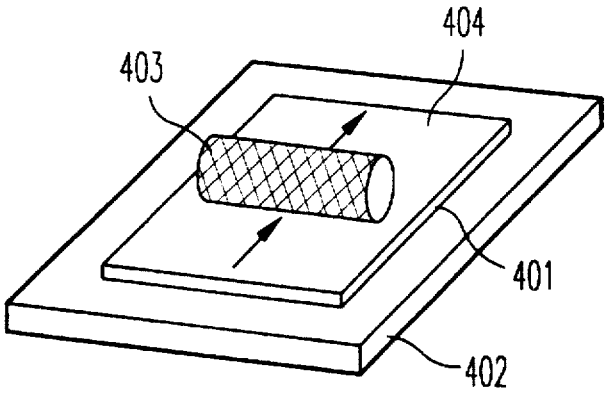
FIG. 9 is a perspective view schematically illustrating a protecting layer cutting device.
Figure 10A:
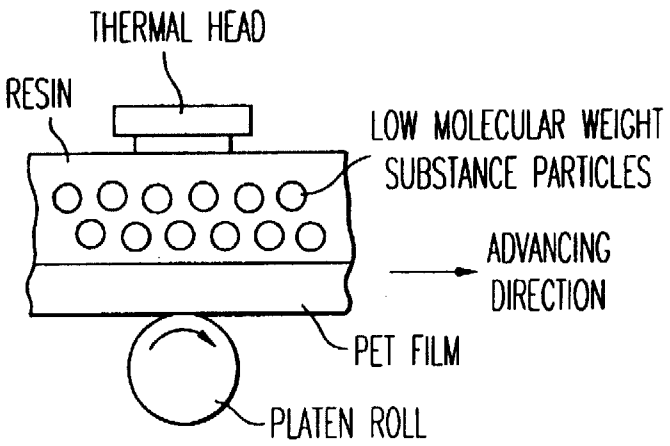
FIGS. 10(*a*)–10(*d*) show an influence of a heat generator upon a reversible thermosensitive recording material according to conventional image formation.
Figure 10B:
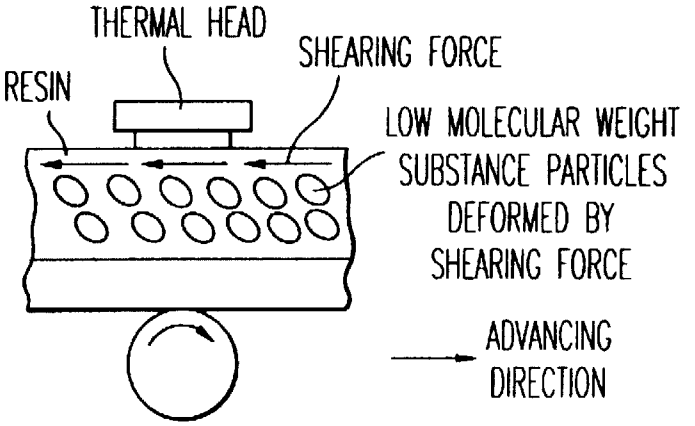
Figure 10C:
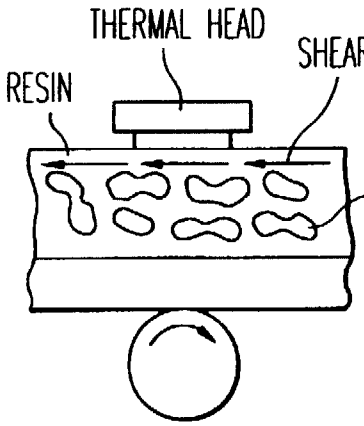
Figure 10D:
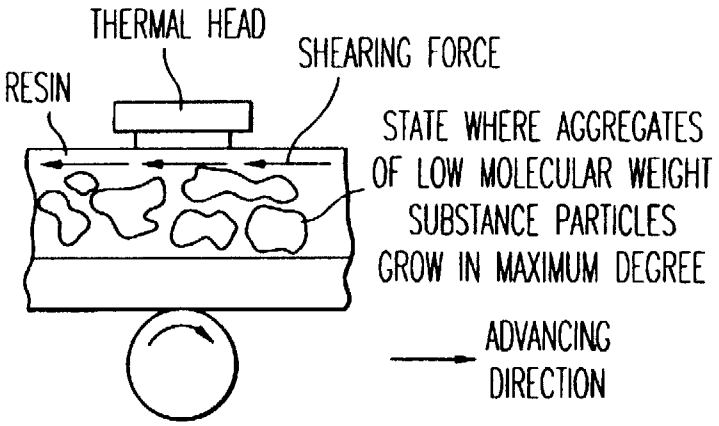
Figure 11A:
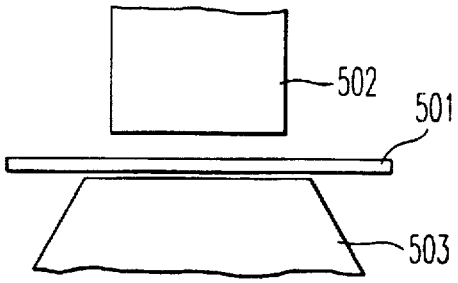
FIGS. 11(*a*)–11(*d*) various specific embodiments of image erasing means of a thermosensitive recording image formation device.
Figure 11B:
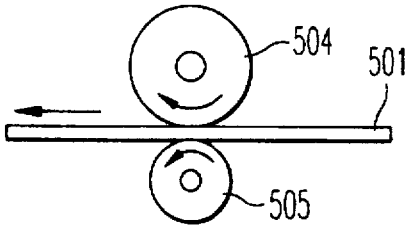
Figure 11C:
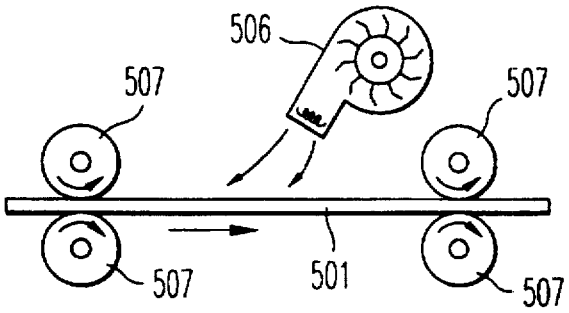
Figure 11D:
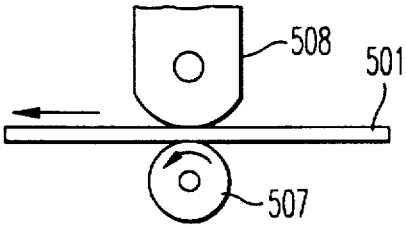

When a protecting layer is provided over the thermosensitive layer formed on the support, the measurement of the level difference is performed after exposing the thermosensitive layer by the following method. First, the thickness of each of the thermosensitive layer and the protecting layer is determined by observation of the cross-section with the above-described TEM, SEM or the like device. The protecting layer is then removed as follows. As shown in FIG. 9, the recording material 401 of the above-described construction is fixed on a stainless steel base plate with a thickness of 2 mm with the protecting layer being oriented upward. A surface abrading member 403 including a brass cylinder with a diameter of 3.5 cm and a sand paper (roughness: No. 800) provided around the cylinder is placed on the surface of the protecting layer. The abrading member 403 is displaced in parallel in one direction as shown by the arrow 404, while being supported and prevented from rotating the cylinder. The pressure applied in the tangential direction is in the range of 1.0–1.5 kg/cm$^2$. The cutting of the surface by reciprocating the abrading member is performed until the thickness is reduced by a degree corresponding to the thickness of the protecting layer. Thus, the thickness of the recording material 401 prior to the surface cutting is previously measured with an electric micrometer (film thickness measuring device) and the thickness of the recording material after each cutting operation is measured. Although the surface is roughened by the removal of the protecting layer, the roughness does not adversely affect the measurement of the level difference caused by application of heat and pressure.

It is thus possible to expose the surface of the recording layer by the above method not only when the recording material has a structure in which the recording layer is overlaid with a protecting layer as above but also when the recording material has a structure in which an intermediate layer is interposed between the recording layer and the protecting layer, in which the protecting layer is overlaid with a printed layer or in which the recording layer is overlaid with a heat resistant film, thereby enabling the measurement of the level difference.

The rate of change in gel fraction of the resin constituting the thermosensitive layer of the reversible thermosensitive recording material according to the present invention is a property showing a change of the degree of cross-linkage of the resin with time. The smaller the rate of change, the better is the stability of the cross-linkage. When the rate of change in gel fraction is 110% or less, the hardness and the stability of the thermal properties of the coated layer are significantly improved. It is considered that the durability in repeated use and in erasability of the recording material is stabilized for the above reason.

The rate of change in gel fraction is given by the following equation:

$$G_C(\%)=|(G_I-G_D)/G_I|\times 100$$

$G_C$: rate of change in gel fraction (%)

$G_I$: initial gel fraction (%)

$G_D$: deferred gel fraction (%)

The initial gel fraction $G_I$ is the value first measured after the formation of an image. It is not necessary that measurement of the initial gel fraction should be carried out immediately after the formation of the image.

The deferred gel fraction $G_D$ is the value measured after holding a sample, similar to that used in the measurement of the initial gel fraction, at 50° C. for 24 hours.

To obtain an effect of improving the durability of images and improving the heat resistance upon application of excess energy, the gel fraction of the resin constituting the thermosensitive layer of the reversible thermosensitive recording material according to the present invention is 30% or more, preferably 50% or more, more preferably 70% or more, most preferably 80% or more.

The gel fraction is measured by the following method. A thermosensitive layer of an arbitrary thickness is formed on a support and is irradiated with electronic beam. The layer is peeled off from the support and the initial weight of the layer is measured. The layer is sandwiched by 400 mesh nets and is immersed for 24 hours in a solvent capable of dissolving the resin before cross-linking. The layer is dried under vacuum and the weight thereof is measured. The gel fraction is calculated as follows:

$$\textit{Gel fraction}(\%)=[\textit{dried weight}(g)/\textit{initial weight}\ (g)]\times 100$$

In calculation of the gel fraction, it is necessary to exclude the weight of substances contained in the thermosensitive layer, such as organic low molecular weight material, other than the resin. Thus, the gel fraction is calculated according to the following equation:

$$\textit{Gel fraction}(\%)=[\textit{dried weight}\ (g)/(\textit{initial weight}(g)-\textit{weight of organic low molecular weight material}(g))]\times 100$$

When the weight of the organic low molecular weight material is not previously known, the cross-section of the thermosensitive layer is observed by the above-described TEM or SEM determine the proportion of the area of each of the resin and the organic low molecular weight material, whereupon the weight proportions of respective components are calculated from the specific gravity of respective components. Thus, the weight of the organic low molecular weight material may be calculated and the gel fraction is then calculated.

When other layers are provided over the thermosensitive layer on a support or when other layer is interposed between the support and the thermosensitive layer, the following method is adopted. The thickness of each of the thermosensitive layer and other layer is measured by analysis of the cross-section by TEM, SEM or the like method. The surface is then cut in the manner described previously by a thickness corresponding to the thickness of the other layer to expose the thermosensitive layer. The thermosensitive layer is peeled off from the support and the gel fraction is measured by the method described above. When a protecting layer containing a UV-hardenable resin is provided on the thermosensitive layer, it is advisable to slightly cut the thermosensitive layer in addition to the protecting layer in order to prevent the contamination of the thermosensitive layer by the protecting layer and to minimize the influence of the protecting layer upon the gel fraction.

The gel fraction may be also measured by the following methods. In the first method, non-crosslinked resin in the hardened coated layer is extracted (for 4 hours) with a solvent capable of dissolving the non-cross-linked resin using a Soxhlet extractor to determine the weight percentage of the non-extracted residue. In the second method, a thermosensitive coating is formed a surface-treated PET support and is then irradiated with an electron beam. After immersion in a solvent, the thickness ratio of the layer after the immersion to that before the immersion is determined. In the third method, a solvent is dropped with a pippet in an amount of about 0.2 ml onto a surface of a thermosensitive layer formed in the same manner as in the second method. After standing for 10 second, the solvent is wiped. The thickness ratio of the layer after the dropping to that before the dropping is determined.

In the first method, the weight of the organic low molecular weight material is excluded from the calculation. In the second and third methods in which the thickness of the coated layer is measured, on the other hand, it is not necessary to take the organic low molecular weight material into consideration, since the thickness of the layer is considered to be unchanged if the resin matrix surrounding the organic low molecular weight material is completely cross-linked.

When the thermosensitive layer is overlaid with other layer as described above, the first method can be carried out in the manner described above while the second and third methods, which pertain to the measurement of the thickness, are performed after cutting the overlaying layer only.

The present inventors have analyzed and investigated a mechanism by which a reduction of the image density or contrast is caused upon repeated formation and erasure of the images on the reversible thermosensitive recording material. As a result, the following phenomena were observed when the image formation on the recording material was performed by pressing a heat generator, such as a thermal head or a printer for heat composition type thermosensitive recording materials, against the surface of thereof.

In the reversible thermosensitive recording material having a recording layer in which particles of the organic low molecular weight material are dispersed into a resin matrix, no such a strain as to cause a change of the state in which the components constituting the recording layer are present does not occur, when the energy for forming or erasing an image with the heat generator has not yet been applied or when the number of the repetition of the formation and erasure is small. In this case, the layer is as illustrated in FIG. 10(*a*), the particles of the organic low molecular weight material are uniformly dispersed into the resin matrix. (As will be understood from the description hereinafter, the uniformity of the particles of the organic low molecular weight material is maintained in the recording material according to the present invention even after repeated recording and erasure operations.) When an image forming means such as the heat generator is displaced, under pressure, relative to the recording material for the formation of images, a stress is applied within the recording layer. Upon repeated application of the energy in the same direction, a strain is caused, as shown in FIG. 10(*b*), due to the stress, so that the particles of the organic low molecular weight material are deformed. As the energy application is further repeated in the same direction, the deformed particles of the organic low molecular weight material agglomerate with each other as shown in FIG. 10(*c*). Finally, the agglomerated particles are further combined with each other to bring about a state where agglomeration of the particles of the low molecular weight material is maximized as shown in FIG. 10(*d*). In such as state, it is almost impossible to form an image and a so-called deteriorated state is reached. The lowering of the image density after repeated formation and erasure of images on reversible thermosensitive recording materials is considered to be based on the foregoing phenomena.

The present inventors has found, as described previously, that the object of the present invention can be achieved by maintaining the level difference caused by application of heat and pressure at 40% or less and by maintaining the rate of change in level difference at 70% or less. The preferred embodiments in this respect will be described below.

When the level difference caused by application of heat and pressure in the thermosensitive layer of the reversible thermosensitive recording material is 40% or less, there is obtained a contribution to improve the durability in repeated use. This is considered to be attributed to the fact that, as compared with the conventional recording materials, the level difference caused by application of heat and pressure in the thermosensitive layer of the reversible thermosensitive recording material is extremely smaller and the heat resistance and the mechanical strengths of the thermosensitive layer are very superior. Thus, the particles of the organic low molecular weight material contained in the thermosensitive layer are hardly agglomerated or maximized so that the deterioration during repeated formation and erasure of images is minimized to maintain a high image contrast.

To attain this purpose, the level difference caused by application of heat and pressure is 40% or less, preferably 30% or less, more preferably 25% or less, most preferably 20% or less.

When the rate of change in level difference caused by application of heat and pressure of the thermosensitive layer is 70% or less, there is obtained contribution to improve the stability of the erasability characteristics with lapse of time. This is considered to be attributed to the fact that the properties of the thermosensitive layer upon lapse of time do not change from the initial state since the rate of change in level difference caused by application of heat and pressure of the thermosensitive layer of the recording material of the present invention is very small, so that the erasability characteristics do not vary upon lapse of time and are stable.

To obtain such an effect, the rate of change in level difference caused by application of heat and pressure is 70% or less, preferably 50% or less, more preferably 45% or less, most preferably 40% or less.

To make the level difference caused by application of heat and pressure 40% or less, a resin used in the reversible thermosensitive recording layer plays an important role. It is necessary that the resin has a certain degree of hardness when heated at a high temperature.

In particular, there may be mentioned the following measures: to use a resin having a high softening point; to use a high softening point resin as a main chain and a low softening point resin as side chains, and to cross-link the resin. Above all, to cross-link the resin is preferable.

The object of the present invention may be achieved, as described previously, by use a cross-linked resin in the thermosensitive layer of the reversible thermosensitive recording material and by maintain the rate of change in gel fraction of the resin at 110% or less. In this case, it is preferred that the gel fraction of the resin of the resin be 30% or more, it is more preferred that the resin be cross-linked with a cross-linking agent and it is most preferred that the resin be cross-linked by irradiation with electron beam or UV radiation, for reasons of obtaining enhanced effects. This is considered to be attributed to the fact that the rate of change in gel fraction of the cross-linked resin contained in the thermosensitive layer of the recording material of the present invention is very small, namely the change of the hardened degree upon lapse of time is very small, whereby the erasability characteristics are stabilized. To achieve this effect, the rate of change in gel fraction is 110% or less, preferably 90% or less, more preferably 70% or less, most preferably 50% or less. Further, it is considered that, since the gel fraction of the cross-linked resin of the recording material of the present invention is high, the heat resistance and the mechanical strengths of the image forming section is further improved so that the durability in repeated operations as well as the resistance to cracks of the printed portion of the image forming section are further improved. To achieve this effect, the gel fraction is 30% or more, preferably 50% or less, more preferably 70% or less.

As a method for cross-linking the resin contained in the reversible thermosensitive layer, heating, ultraviolet irradiation (UV irradiation) or electron beam irradiation (EB irradiation) may be adopted. Preferably UV or EB irradiation, more preferably EB irradiation, is adopted, for the reasons as set forth below.

The hardening of a resin by EB irradiation differs from that by UV irradiation in that the latter method needs a photopolymerization initiator and a photosensitizer and is effective to a transparent resin only. With the EB irradiation method, a radical reaction rapidly proceeds so that the polymerization is completed instantaneously. Further, because of a high energy of EB irradiation, the thickness of the layer to be hardened can be made thick. With the UV irradiation method, the additives, i.e. the photopolymerization initiator and the photosensitizer, remain in the cross-linked recording layer and might adversely affect the formation and erasure operations and the durability of repeated operations.

A thermal hardening method requires the use of a catalyst and a promoter for cross-linking. Even with these additives, the hardening time is much slower than that with the EB irradiation method. Further, these additives remain in the cross-linked recording layer and might cause problems similar to those in the UV irradiation method. Moreover, the cross-linking proceeds little by little after the heating so that the characteristics of the recording layer will change upon lapse of time.

For the above reasons, the cross-linking by EB irradiation is best suited. Additionally, the recording materials obtained using EB irradiation can prevent the deterioration of the density of an image formed by a high energy printing and can maintain high contrast.

The present invention is based on the foregoing findings.

The resin used for the purpose of the present invention will now be described below.

The use of the resin having a low softening point is effective to broaden the temperature range for transparentization. Thus, it is preferred that the resin has a softening point of 70° C. or less, more preferably 65° C. or less, most preferably 60° C. or less. In this case, the lower limit of the softening point is preferably higher than the crystallization point of the organic low molecular weight material in the white opaque state.

The softening point may be measured by the following method. A recording layer of an arbitrary thickness is formed on a support. The layer is peeled off from the support and is measured for the softening point using a thermomechanical analyzer (TMA) or a dynamic viscoelasticity measuring device. Alternatively, a rigid body pendulum dynamic viscoelasticity measuring device may be used for measuring the softening point without peeling the recording layer.

The low softening point resin may be, for example, a resin having long side chains or a resin copolymerized with a low softening point resin. The side chain of the long side chain-bearing resin preferably has at least 3 carbon atoms in terms of an alkyl group. The side chain may contain an ether linkage or an ester linkage or have a carboxyl group or a hydroxyl group at the terminal end thereof.

Examples of the main chains include poly(vinyl chloride), polycarbonate, a phenoxy resin, polystyrene, a chlorinated vinyl chloride resin and copolymers thereof.

In a vinyl chloride-vinyl ester copolymer used in the present invention, the fatty acid constituting the vinyl ester has at least 3 carbon atoms, namely propionic acid or higher fatty acid.

Illustrative of such vinyl chloride-vinyl ester copolymers are vinyl chloride-vinylpropionate copolymers, vinyl chloride-vinyl butyrate copolymers, vinyl chloride-vinyl valerianate copolymers, vinyl chloride-vinyl caproate copolymers, vinyl chloride-vinyl enanthate copolymers, vinyl chloride-vinyl caprylate copolymers, vinyl chloride-vinyl pelargonate copolymers, vinyl chloride-vinyl caprate copolymers, vinyl chloride-vinyl undecanoate copolymers, vinyl chloride-vinyl tridecylate copolymers, vinyl chloride-vinyllaurate copolymers, vinyl chloride-vinyl myristate copolymers, vinyl chloride-vinyl pentadecylate copolymers, vinyl chloride-vinyl palmitate copolymers, vinyl chloride-vinylpropionate copolymers, vinyl chloride-vinylpropionate copolymers, vinyl chloride-vinyl margarate copolymers, vinyl chloride-vinyl stearate copolymers, vinyl chloride-vinyl nonadecylate copolymers, vinyl chloride-vinyl arachidate copolymers, vinyl chloride-vinyl behenate copolymers, vinyl chloride-vinyl lignocerate copolymers, vinyl chloride-vinyl cerotate copolymers, vinyl chloride-vinyl montanate copolymers and vinyl chloride-vinylmelissate copolymers.

The structure of the above vinyl ester having a normal-form of a strain chain may be changed to a branched form. Examples of such esters include vinyl chloride-vinyl isopropionate copolymers, vinyl chloride-vinyl isobutyrate copolymers, vinyl chloride-vinyl isovalerianate copolymers and vinyl chloride-vinyl isocaproate copolymers. The present invention is not limited to the above examples.

The copolymerization ratio of these copolymers is preferably such that the weight ratio of the vinyl chloride unit to the vinyl ester unit is 99/1 to 20/80.

The average polymerization degree is preferably P =100 or more, more preferably P=200 or more, most preferably P=300 or more.

A vinyl chloride-ethylene copolymer used in the present invention is preferably one having an ethylene content of at least 1%, more preferably at least 2%, most preferably at least 4% among those having low ethylene grade to high ethylene grade copolymers. A copolymer having a high ethylene content is preferred, because the greater the ethylene content is, the lower becomes the softening point.

The average polymerization degree of these copolymers is preferably P=200 or more, more preferably P=300 or more, most preferably P=400 or more.

In addition to the above resins, the low softening point resin may be a vinyl chloride vinyl ether copolymer expressed by the following general formula (I):

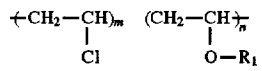

(I)

where $R_1$ represents an alkyl group. The alkyl group of the vinyl alkyl ether preferably has at least 3 carbon atoms.

The above-described resins may be used singly or as a mixture of two or more and may be used in combination with the following resins:

poly(vinyl chloride); vinyl chloride copolymers such as vinyl chloride-vinyl acetate copolymers, vinyl chloride-vinyl acetate-vinyl alcohol copolymers, vinyl chloride-vinyl acetate-maleic acid copolymers and vinyl chloride-acrylate copolymers; poly(vinylidene) chloride; vinylidene chloride copolymers such as vinylidene chloride-vinyl chloride copolymers and vinylidene chloride-acrylonitrile copolymers; polyesters; polyamides; polyacrylate, polymethacrylate or acrylate-methacrylate copolymers; silicone resins; polyethylene; polypropylene; polystyrene; polyacrylamide; polyvinylpyrrolidone; natural rubber; polyvinyl alcohol; polyacrolein; and polyacarbonate.

The organic low molecular weight material should be in the form of particles in the recording layer. Generally used is a material having a melting point of 30°–200° C., preferably 50°–150° C. Examples of the organic low molecular weight materials include alkanols; alkanediols; halogenated alkanols; halogenated alkane diols; alkylamines; alkanes; alkenes; halogenated alkanes; halogenated alkenes; halogenated alkynes; cycloalkanes; cycloalkenes; cycloalkynes; saturated or unsaturated mono or dicarboxylic acids or esters, amides or ammonium salts thereof; saturated or unsaturated halogenated fatty acids or esters, amides and ammonium salts thereof; allylcarboxylic acid or esters, amides or ammonium salts thereof; halogenated allylcarboxylic acid or esters, amides or ammonium salts thereof; thiols; thiocarboxylic acids or esters, amines or ammonium salts thereof; and carboxylic acid esters of thiols. These compounds may be used by themselves or as a mixtures of two or more. These compounds have 10–60 carbon atoms, preferably 10–38 carbon atoms, more preferably 10–30 carbon atoms. The alcohol group of the ester may be saturated or unsaturated or may be substituted with a halogen. It is preferred that the low molecular weight material have at least one of oxygen, nitrogen, sulfur and halogen in its molecule, such as —OH, —COOH, —CONH—, —COOR, —NH—, —$NH_2$, —S—, —S—S—, —O— or halogen.

In the present invention, it is preferred that a low melting point organic low molecular weight compound and a high melting point organic low molecular weight compound be used in combination as the low molecular weight material. The difference in melting point between the low and high melting point compounds is preferably at least 20° C., more preferably at least 30° C., most preferably at least 40° C.

The low melting point organic low molecular weight compound preferably has a melting point of lower than 100° C. but not lower than 40° C., more preferably between 50° and 80° C., whereas the high melting point organic low molecular weight compound preferably has a melting point of at least 100° C., more preferably at least 110° C.

The low melting point organic low molecular weight compound is preferably a fatty acid ester, an ester of dibasic acid or a difatty acid ester of a polyhydric alcohol, as described hereinafter. These esters may be used by themselves or as a mixture of one or more.

The fatty acid ester used in the present invention is characterized in that the melting point thereof is lower than the fatty acid (two molecules being in the associated state) having the same carbon number and in that the carbon number thereof is greater than the fatty acids having the same melting point.

Deterioration of images during repeated printing-erasure with a thermal head is considered to be caused by a change of a dispersed state of particles of an organic low molecular weight material due to the dissolution of the organic low molecular weight material in the resin matrix during a heating stage. It is believed that the compatibility of the resin matrix with the low molecular weight material is lowered with an increase of the carbon number of the low molecular weight material, so that the deterioration of images by printing-erasure operations decreases. Further, the white opaqueness tends to increase in proportion with an increase of the carbon number.

Thus, in reversible thermosensitive recording materials having the same transparentizing temperature, the use of the fatty acid ester as the organic low molecular weight material to be dispersed in the resin matrix gives an improvement in white opaqueness (namely contrast) and durability in repeated use as compared with the case in which a fatty acid is used.

By using such a fatty acid ester in conjunction with a high melting point low molecular weight compound, the transparentizing temperature range can be broadened and the erasure characteristics by a thermal head can be improved. As a consequence, even when the erasure characteristics change during storage, the recording material still permits the erasure. In addition, because of the characteristics of the recording material itself, the durability in repeated use can be improved.

The fatty acid ester suitably used in the present invention may be, for example, represented by the following general formula (II):

$$R_1—COO—R_2 \quad \text{(II)}$$

wherein $R_1$ and $R_2$ each represent an alkyl group having at least 10 carbon atoms.

The fatty acid ester preferably has at least 20 carbon atoms, more preferably at least 25 carbon atoms, most preferably at least 30 carbon atoms. As the carbon number increases, the durability in repeated use is improved. The fatty acid ester preferably has a melting point of at least 40° C. and is used singly or in combination of two or more.

Illustrative of suitable fatty acid esters are:

octadecyl palmitate, docosyl palmitate, heptyl stearate, octyl stearate, octadecyl stearate, docosyl stearate, octadecyl behenate and docosyl behenate.

The ester of dibasic acid may be monoester or diester and may be represented by the following general formula (III):

$$ROOC—(CH_2)_nCOOR' \quad \text{(III)}$$

where R and R' represent, independently from each other, a hydrogen atom or an alkyl group having 1–30 carbon atoms with the proviso that at least one of R and R' represents the alkyl group, and n is an integer of 0–40.

In the ester of a dibasic acid represented by the formula (III), the alkyl groups R and R' preferably have 1–22 carbon atoms, while n is preferably 1–30, more preferably 2–20. The ester preferably has a melting point of at least 40° C.

Illustrative of the ester of a dibasic acid are esters of succinic acid, esters of adipic acid, esters of sebacic acid and esters of 1,18-octadocamethylenedicarboxylic acid.

The difatty acid ester of a polyhydric alcohol used as the organic low molecular weight material may be a compound expressed by the following general formula (IV):

$$CH_3(CH_2)_{m-2}COO(CH_2)_n\ OOC(CH_2)_{m-2}CH_3 \quad \text{(IV)}$$

in which n is an integer of 2–40, preferably 3–30, more preferably 4–22 and m is an integer of 2–40, preferably 3–30, more preferably 4–22.

Illustrative of the difatty acid ester are 1,3-propanediol dialkanoic acid esters, 1,6-hexanediol dialkanoic acid esters, 1,10-decanediol dialkanoic acid esters and 1,18-octadecanediol dialkanoic acid esters.

The difatty acid ester of a polyhydric alcohol is characterized in that the melting point thereof is lower than the fatty acid having the same carbon number and in that the carbon number thereof is greater than the fatty acids having the same melting point. Durability in repeated printing with a thermal head is considered to be influenced by the compatibility of the resin with the low molecular weight material and the compatibility is lowered with an increase of the carbon number of the low molecular weight material. Further, the white opaqueness tends to increase in proportion with an increase of the carbon number. Thus, in reversible thermosensitive recording materials having the same transparentizing temperature (which is near the melting point), the use of the difatty acid ester of a polyhydric alcohol gives an improvement in durability in repeated use as compared with the case in which a fatty acid is used.

The difatty acid ester of a polyhydric alcohol which has a low melting point gives white opaqueness and durability in repeated use which are comparable to those attained by the use of a fatty acid with a higher melting point. Thus, by using such a difatty acid ester in conjunction with a high melting point low molecular weight compound so as to broadening the transparentizing temperature range, the transparentizing temperature range can be broadened while ensuring white opaqueness and durability in repeated use comparable to those attained by the use of a fatty acid. Furthermore, the erasure (transparentization) of the images by short time heating with a thermal head, etc. can be improved. Additionally, even when the image erasing energy is varied with time due to an increased margin of the image erasure, there is caused no actual problem and the erasure may be made with a thermal head.

As the high melting point organic low molecular weight compound used in the present invention, there may be mentioned saturated aliphatic dicarboxylic acids, ketones having a higher alkyl group, semicarbazones derived from the ketones and α-phosphonofatty acids. Examples of suitable high melting point compounds include those illustrated below. The present invention is not limited to the examples. These high melting point compounds may be used by themselves or as a mixture of two or more thereof. Illustrative of the high melting point compounds having a melting point of at least 100° C. are shown below. Examples of aliphatic dicarboxylic acids having a melting point of 100° to about 135° C. are succinic acid, glutaric acid, adipic acid, pimelic acid, suberic acid, azelaic acid, sebacic acid, undecanedicarboxylic acid, dodecanedicarboxylic acid, tetradecanedicarboxylic acid, pentadecanedicarboxylic acid, hexadecanedicarboxylic acid, heptadecanedicarboxylic acid, octadecanedicarboxylic acid, nonadecanedicarboxylic acid, eicosanedicarboxylic acid, heneicosanedicarboxylic acid and docosanedicarboxylic acid.

The ketone used in the present invention contains a ketone group and a higher alkyl group as essential constituents and may additionally contain a substituted or non-substituted aromatic or heterocyclic group. The total number of carbon atoms of the ketone is preferably at least 16, more preferably at least 21. The carbazones used in the present invention are derived from the above ketone.

Examples of the ketone and carbazone include 3-octadecanone, 7-icosanone, 14-heptacosanone, 18-pentatriacontanone, tetradecanophenone, docolinophenone, docasanonaphthophenone and 2-heneicosanonesemicarbazone.

The α-phosphonofatty acid used in the present invention may be obtained by, for example, by the method disclosed by E. V. Kaurer et al in J. Ak. Oil Chekist's Soc., 41, 205 (1964). In this method, a fatty acid is brominated by the Hell-Volhard-Zelinskin reaction to α-brominated product which in turn is esterified with ethanol to obtain α-bromofatty acid ester. This is reacted with heating with triethylphosphite to obtain α-phosphonofatty acid ester. The ester is hydrolyzed with concentrated hydrochloric acid and the product is recrystallized from toluene.

Illustrative of the phosphonofatty acid are α-phosphonomyristic acid, α-phosphonopalmitic acid and α-phosphonostearic acid. These compounds have two melting points.

The weight ratio of the low melting point organic low molecular weight compound to the high melting point organic low molecular weight compound is preferably 95:5 to 5:95, more preferably 80:20 to 20:80. Into the mixture of the above low melting point and high melting point compounds, other organic low molecular weight substances may be incorporated.

Illustrative of these substances are higher fatty acids such as lauric acid, dodecanoic acid, myristic acid, pentadecanoic acid, palmitic acid, stearic acid, behenic acid, nonadecanoic acid, arachic acid and oleic acid and the following ethers or thioethers: $C_{16}H_{33}$—O—$C_{16}H_{33}$, $C_{16}H_{33}$—S—$C_{16}H_{33}$, $C_{18}H_{37}$—S—$Cl_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$, $H_{23}C_{11}COOCH_2CH_2$—O—$CH_2CH_2OCOC_{11}H_{23}$, $H_{35}C_{17}COOCH_2CH_2$—O—$CH_2CH_2OCOC_{17}H_{35}$, $H_3CCH_2CHCH_3(CH_2)_{15}COOCH_2CH_2$—$CH_2CH_2OCO(CH_2)_{15}CHCH_3CH_2$ $CH_3$, $H_{25}C_{12}COOCH_{12}CH_2$—S—$CH_2CH_2OCOC_{12}H_{25}$, $H_{37}C_{18}COOCH_2CH_2$—S—$CH_2CH_2OCOC_{18}H_{37}$, $H_3CCH_2CHCH_3(CH_2)_{15}COOCH_2CH_2$—S—$CH_2CH_2OCO(CH_2)_{15}CHCH_3CH_{2CH3}$. $H_{37}C_{18}COOCH_2CH_2$—NH—$CH_2CH_2OCOC_{18}H_{37}$ and $H_3CCH_2CHCH_3(CH_2)_{13}COOCH_2CH_2$—NH—$CH_2CH_2OCO(CH_2)_{13}CHCH_3CH_3CH_2CH_3$.

Above all, it is preferable to use a higher fatty acid, especially a higher fatty acid having at least 16 carbon atoms such as palmitic acid, pentadecanoic acid, noadecanoic acid, arachic acid, behenic acid or lignoceric acid, more preferably a higher fatty acid having 16–24 carbon atoms.

As described previously, in the present invention, the widening of the transparentizing temperature range may be achieved by suitably combining the aforementioned organic low molecular weight compounds or by using the organic low molecular weight compounds with other substances having a different melting point. These are disclosed, for example, in Japanese Laid-Open Patent Applications Nos.

63-39378 and 63-130380 and Japanese Patent Applications Nos. 3-2089 and 63-14754 but are not limited only thereto.

The weight ratio of the organic low molecular weight material to the resin (resin having a cross-linked structure) in the recording layer is preferably 2:1 to 1:16, more preferably 1:2 to 1:8. A proportion of the resin below the above range causes a difficulty in forming a film in which the organic low molecular weight material is retained in the resin. An amount of the resin above the above range also causes a difficulty in transparentization because the amount of the organic low molecular weight material is small.

The reversible thermosensitive recording material according to the present invention is generally prepared by applying onto a substrate such as a plastic film, a glass plate or a metal plate (1) a solution in which the two ingredients of the resin matrix and the organic low molecular weight material has been dissolved or (2) a dispersion in which the organic low molecular weight material in the form of fine particles has been dispersed in a solution of the resin matrix (using a solvent in which at least one compound of the organic low molecular weight material is not soluble). This is then dried to form a thermosensitive layer of a laminate.

A solvent for the formation of the thermosensitive layer or thermosensitive recording material may be selected in various ways according to the kinds of the resin matrix and the organic low molecular weight material and may be, for example, tetrahydrofuran, methyl ethyl ketone, methyl isobutyl ketone, chloroform, carbon tetrachloride, ethanol, toluene or benzene. In the thermosensitive layer obtained not only from a dispersion but also from a solution, the organic low molecular weight material exist in the form of fine particles dispersed therein.

It is preferred that the recording layer have a thickness of 1–30 μm, more preferably 2–20 μm. Too large a thickness of the recording layer causes a difficulty in uniformly transparentizing the recording layer since a temperature variation occurs in the layer. Too small a thickness of the recording layer, on the other hand, causes a reduction of the white opaqueness and the contrast. By increasing the amount of the organic low molecular weight material in the thermosensitive layer, the white opaqueness can be increased.

The recording layer may contain, in addition to the above ingredients, additives such as a surfactant and a plasticizer to facilitate the formation of transparent images. Examples of the additives include as follows.

As the plasticizer, there may be mentioned phosphoric acid esters, fatty acid esters, phthalic acid esters, dibasic acid esters, glycols, polyester plasticizers and epoxy plasticizers. Specific examples of the plasticizers are as follows:

tributyl phosphate, tri-2-ethylhexyl phosphate, triphenyl phosphate, ticresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelaate, dibutyl sebacate, di-2-ethylhexyl sebacate, diethyleneglycol dibenzoate, triethyleneglycol di-2-ethylbutylate, methyl acetylricinoleate, butyl acetylricinoleate, butyl phtharylbutylglycolate and tributyl acetylcitrate.

Examples of surfactants and other additives are as follows: higher fatty acid esters of a polyhydric alcohol; higher alkyl ethers of a polyhydric alcohol; lower olefin oxide adducts of a polyhydric alcohol higher fatty acid ester, a higher alcohol, a higher alkylphenol, a higher fatty acid higher alkylamine, a higher fatty acid amide, a fat or a polypropylene glycol; acetylene glycol; Na, Ca, Ba or Mg salts of a higher alkylbenzenesulfonic acid; Ca, Ba or Mg salts of an aromatic carboxylic acid, a higher fatty acid sulfonic acid, aromatic sulfonic acid, sulfuric acid monoester or mono or diester of phosphoric acid; low degree sulfonated oil; poly(long chain alkyl acrylate); acrylic oligomers; poly(long chain alkyl methacrylate); copolymers of long chain alkylmethacrylate with amine-containing monomer; styrene-maleic anhydride copolymers; and olefin-maleic anhydride copolymers.

As described previously, the resin of the recording layer of the present invention may be cross-linked by heating or by irradiation with ultraviolet rays or electron beams. Of these, the irradiation with electron beams is preferably adopted. Specific examples of the cross-linking method include (i) a method in which a cross-linkable substance is used as the resin, (ii) a method in which a cross-linking agent is used, (iii) a method in which the cross-linking is performed by irradiation with ultraviolet rays or electron beams, and (iv) a method in which the cross-linking is performed by irradiation with ultraviolet rays or electron beams in the presence of a cross-linking agent.

The cross-linking agent may be, for example, a non-functional monomer or a functional monomer. Illustrative of the cross-linking agents are as follows:

Examples of non-functional monomers:

(1) methyl methacrylate (MMA)
(2) ethyl methacrylate (EMA)
(3) n-butyl methacryalate (BMA)
(4) i-butyl methacrylate (IBMA)
(5) t-butyl methacrylate (TBMA)
(6) 2-ethylhexyl methacryalate (EHMA)
(7) lauryl methacrylate (LMA)
(8) alkyl methacrylate (SLMA)
(9) tridecyl methacryalate (TDMA)
(10) stearyl methacrylate (SMA)
(11) cyclohexyl methacrylate (CHMA)
(12) benzyl methacryalate (BZMA)

Examples of monofunctional monomers:

(13) methacrylic acid (MMA)
(14) 2-hydroxyethyl methacrylate (HEMA)
(15) 2-hydroxypropyl methacryalate (HPMA)
(16) dimethylaminoetyl methacrylate (DMMA)
(17) dimethylaminoethyl methacrylate methylchloride salt (DMCMA)
(18) diethylaminoethyl methacryalate (DEMA)
(19) glycidyl methacrylate (GMA)
(20) tetrahydrofurfryl methacrylate (THFMA)
(21) allyl methacryalate (AMA)
(22) ethylene glycol dimethacrylate (EDMA)
(23) triethylene glycol dimethacrylate (3EDMA)
(24) tetraethylene glycol dimethacrylate (4EDMA)
(25) 1,3-butylene glycol dimethacrylate (BDMA)
(26) 1,6-hexandiol dimethacrylate (HXMA)
(27) trimethylolpropane trimethacrylate (TMPMA)
(28) 2-ethoxyethyl methacrylate (EDMA)
(29) 2-ethylhexyl acrylate
(30) phenoxyethyl acrylate
(31) 2-ethoxyethyl acrylate
(32) 2-ethoxyethoxyethyl acrylate
(33) 2-hydroxyethyl acrylate

(34) 2-hydroxypropyl acrylate

(35) dicyclopentenyloxyethyl acrylate

(36) N-vinylpyrollidone

(37) vinyl acetate

Examples of difunctional monomers:

(38) 1,4-butanediol acrylate

(39) 1,6-hexanediol diacrylate

(40) 1,9-nonanediol diacrylate

(41) neopentyl glycol diacrylate

(42) tetraethylene glycol diacrylate

(43) tripropyleneglycol diacrylate

(44) tripropylene glycol diacrylate

(45) polypropylene glycol diacrylate

(46) bisphenol A-ethylene oxide adduct diacrylate

(47) glycerin methacrylate acrylate

(48) neopentylglycol-propylene oxide (2 mole) adduct diacrylate

(49) diethylene glycol diacrylate

(50) polyethylene glycol(400) diacrylate

(51) diacrylate of neopentyl glycol hydroxypivalate

(52) 2,2-bis(4-acryloxy-diethoxyphenyl)propane

(53) diacrylate of neopentyl glycol adipate

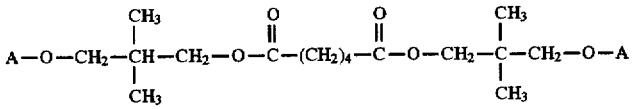

(A herein and hereinafter represents an acryloyl group $CH_2{=}CHCO{-}$)

(54) diacrylate of an adduct of neopentyl glylcol hydroxypivalate with ε-caprolactone

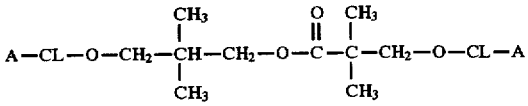

(CL herein and hereinafter represents ε-caprolactone $-O-(CH_2)_5-CO-$)

(55) diacrylate of an adduct of neopentyl glylcol hydroxypivalate with ε-caprolactone

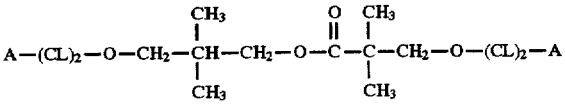

(56) 2-(2-hydroxy-1,1-dimethylethyl)-5-hydroxymethyl-5ethyl-1,3-dioxane diacrylate

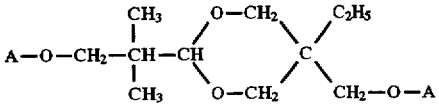

(57) tricyclodecanedimethylol diacrylate

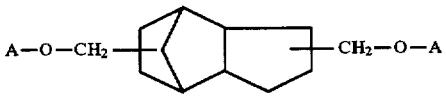

(58) adduct of tricyclodecanedimethylol diacrylate with ε-caprolactone

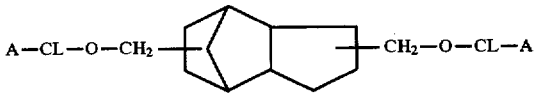

(59) diacrylate of 1,6-hexanediol diglycidyl ether

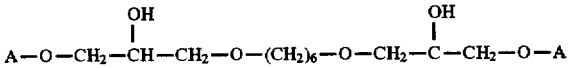

Examples of polyfunctional monomers:

(60) trimethylolpropane triacrylate

(61) pentaerythrytol triacrylate

(62) triacrylate of glycerin propylene oxide adduct

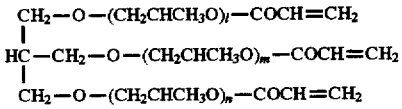

(l+m+n=ca. 3)

(63) trsacryloyloxyethyl phosphate

(64) pentaerythritol tetraacrylate

(65) triacrylate of adduct of trimethylolpropane with propylene oxide (3 moles)

(66) glyceryl propoxide triacrylate

(67) dipenetaerythritol polyacrylate

(68) polycrylate of adduct of dipentaerythritol with caprolactone

(69) triacrylate of dipentaerythritol propionate

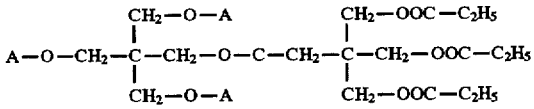

(70) dimethylolpropane triacrylate modified with hydroxypivaldehyde

(71) tetraacrylate of dipentaerythritol propionate

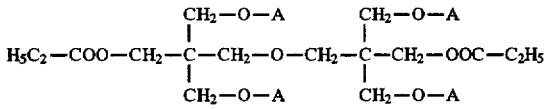

(72) ditrimethylolpropane tetraacrylate

(73) pentaacrylate of dipentaerythritol propionate

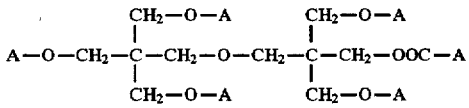

(74) dipentaerythritol hexaacrylate (DPHA)

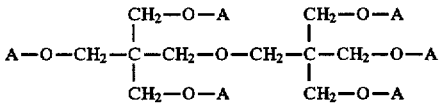

(75) adduct of DPHA with ε-caprolactone

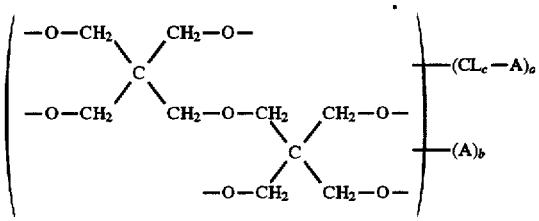

(DPCA-20) a = 2, b = 4, c = 1
(DPCA-30) a = 3, b = 3, c = 1
(DPCA-60) a = 6, c = 1
(DPCA-120) a = 6, c = 2

Examples of oligomers:

(76) adduct of bisphenol A with diepoxy acrylate

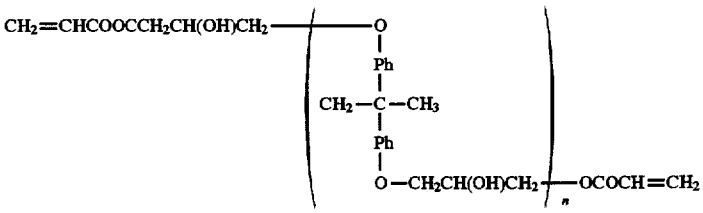

(n = c.a. 1.2, Ph = paraphenylene)

These cross-linking agents are used singly or as a mixture of two or more. The amount of the cross-linking agent is preferably 0.001–1.0 part by weight, more preferably 0.01–0.5 part by weight, per part by weight of the resin. An amount of the cross-linking agent below 0.001 part causes a reduction of cross-linking efficiency, whereas an amount thereof above 1.0 part by weight causes a reduction of white opaqueness and contrast.

As described previously, among the above-described cross-linking agents, the functional monomer is preferred to the non-functional monomer and the polyfunctional monomer is preferred to the monofunctional monomer, for reasons of better cross-linking efficiency with a smaller amount.

When irradiation with ultraviolet rays is adopted to effect cross-linking of the resin of the thermosensitive layer, the following cross-linking agents, photopolymerization initiators and photopolymerization accelerators may be used. The present invention, however, is not limited to the specific examples shown below.

The cross-linking agents may be classified into photopolymerizable prepolymers and photopolymerizable monomers. The photopolymerizable monomers may be the monofunctional monomers and polyfunctional monomers referred to above as the cross-linking agents used in conjunction with irradiation with electron beams.

The photopolymerizable prepolymers may be polyester acrylates, polyurethane acrylates, epoxy acrylates, polyether acrylates, oligoacrylates, alkyd acrylates and polyol acrylates.

These cross-linking agents are used singly or as a mixture of two or more. The amount of the cross-linking agent is preferably 0.001–1.0 part by weight, more preferably 0.01–0.5 part by weight, per part by weight of the resin. An amount of the cross-linking agent below 0.001 part causes a reduction of cross-linking efficiency, whereas an amount thereof above 1.0 part by weight causes a reduction of white opaqueness and contrast.

The photopolymerization initiators may be generally classified into those of a radical reaction type and those of an ionic reaction type. The radical reaction type initiators may be further divided into those of a light cleavage type and those of a hydrogen abstraction type. Specific examples of the initiators are as follows:

benzoin ethers such as isobutyl benzoin ether, isopropyl benzoin ether, benzoin ether and benzoin methyl ether; α-acyloxime esters such as 1-phenyl-1,2-propanedione-2-(o-ethoxycarbonyl)oxime; benzyl ketals such as 2,2-dimethoxy-2-phenylacetophenone and benzyl hydroxycyclohexylphenyl ketone; acetophenones such as diethoxyacetophenone, 2-hydroxy-2-methyl-1-phenylpropane-1-one; ketones (ketone-amine) such as benzophenone, chlorothioxanthone, 2-chlorothioxanthone, isopropylthioxanthone, 2-methylthioxanthone and chlorinated benzophenone.

These photopolymerization initiators are used singly or as a mixture of two or more. The amount of the cross-linking agnet is preferably 0.001–1.0 part by weight, more preferably 0.01–0.5 part by weight, per part by weight of the cross-linking agent.

The photopolymerization accelerators serves to improve the curing speed of the photopolymerization initiators of a hydrogen abstraction type, such as of benzophenone-series and thioxanthone series. Aromatic tertiary amines and aliphatic amines are generally used. Specific examples of the accelerators include isoamyl p-dimethylaminobenzoate and ethyl p-dimethylaminobenzoate. These accelerators are used singly or as a mixture of two or more. The amount of the accelerator is preferably 0.1–5 parts by weight, more preferably 0.3–3 parts by weight, per part by weight of the photopolymerization initiator.

The ultraviolet ray irradiation device used in the present invention is composed of a light source, a lightening tool, a power source, a cooling device and a conveyer. The light source may be a mercury lamp, a metal halide lamp, gallium lamp, mercury xenon lamp or flush lamp. A light source having an emission spectrum corresponding to the ultraviolet absorption wavelength of the photopolymerization initiator and accelerator. The ultraviolet ray irradiation conditions such as lamp output and conveying speed, may be suitably selected according to the radiation energy required for cross-linking the resin.

In the present invention, the following electron beam irradiation is particularly effective for cross-linking the resin of the thermosensitive layer of the reversible thermosensitive recording material.

EB irradiation devices may generally divided into those of a scanning (scan beam) type and a non-scanning (area beam) type. A suitable device may be determined according to the objects such as irradiation area and irradiation dosage. The EB irradiation conditions are determined from the following equation according to the dosage required for cross-linking the resin in view of the electron current, irradiation width and conveying speed.

$$D=(\Delta E/\Delta R)\cdot\eta\cdot I/(W\cdot V)$$

D: dosage required (Mrad)

$\Delta E/\Delta R$: average energy loss $\eta$: efficiency

I: electron current (mA)

W: irradiation width (cm)

V: conveying speed (cm/sec)

Industrial purposes, this is simplified as $$D\cdot V=K\cdot I/W$$

and the device rating is expressed in terms of Mrad·m/min.

The electron current rating is 20–30 mA in the case of a laboratory equipment, 50–100 mA in the case of a pilot machine and 100–500 mA in the case of a production machine.

The cross-linking efficiency varies with the kind and polymerization degree of the resin, the kind and amount of the cross-linking agent and the kind and amount of the plasticizer, so that the gel fraction relative to the dosage is not constant. Therefore, the dosage required for cross-linking the resin is suitably determined according to the target gel fraction which has been determined from a recording layer prepared using predetermined levels of constituents of the thermosensitive layer of the reversible thermosensitive recording material.

When a high energy is required for cross-linking the resin, it is preferred that the irradiation is carried out several times so that the irradiation in each time may prevent the overheating and that the support, the resin or the like is prevented from being deformed or thermally decomposed due to the heat generated by the irradiation.

It is also preferred that the EB irradiation for cross-linking the recording layer be performed after the layer has been heated at a temperature sufficient to melt at least part of the organic low molecular weight material contained therein. It is further preferred that the cross-linking be performed after the layer has been heated at a temperature sufficient to completely melt the organic low molecular weight material.

The relationship between the thermosensitive layer constituents and the gel fraction is as described previously.

The resin is selected from those described above. Since the gel fraction tends to increase as the average polymerization degree (P) becomes high, the polymerization degree of the resin is preferably such that P is 300 or more, more preferably P is 600 or more.

The kind and the amount of the cross-linking agent are as described previously. The kind of the plasticizer is preferably a fatty acid ester, polyester plasticizer or epoxy resin plasticizer among those described previously. The use of an epoxy plasticizer is particularly preferred for reasons of discoloration by irradiation and cross-linking efficiency. As the amount of the plasticizer increases, the gel fraction is improved and, thus, is preferably 0.01–1.0 part by weight, more preferably 0.05–0.5 part by weight, per part by weight of the resin.

In addition to the foregoing measures, the following method is effective to improve the durability in repeated use. Firstly, the durability is improved by shifting the softening point of the thermosensitive layer toward the high temperature side. The higher the softening point, the better the durability. The softening point may be measured with a thermal machine analyzer (TMA) or a dynamic visco-elasticity measuring device using a membrane similar to that used in the measurement of the gel fraction. The softening point is also measured with a rigid body pendulum method-dynamic visco-elasticity measuring device without peeling the recording layer prepared in the manner described above. The variation of the erasure characteristics with time is small when the variation of the softening point with time is small.

Secondly, as described hereinafter, the durability may be improved by laminating a protecting layer over the thermosensitive layer on the support and by increasing the interlayer strength between these layers. The higher the interlayer strength, the better the durability. The interlayer strength may be measured in accordance with Tappi UM-403.

Thirdly, the durability is high when the penetration of the thermosensitive layer in the TMA penetration test is low. The lower the penetration, the better the durability. The penetration test may be carried out using TMA used in the softening point measurement. A probe (penetration probe) having a small tip cross-sectional area is placed on a recording layer on the support and a load is applied to the probe, if necessary, with heating, to measure the displacement of the probe.

Fourth, the durability is high when the residual amount of the cross-linking agent remaining in the thermosensitive layer after EB cross-linking is small. The smaller the residual amount, the better the durability. The residual amount may be measured by the following method.

An ATR measurement auxiliary device mounted to a Fourier transformation infrared spectrophotometer is used as the measuring device and a thermosensitive coated layer used in the above gel fraction measurements used as the sample to be measured. The sample after irradiation with EB is measured for the absorption band intensity attributed to an out-of-plane deformation vibration of an acryloyl group at 810 $cm^{-1}$. The absorption band intensity is proportional to the residual amount of the cross-linking agent. Namely, the intensity decreases with a decrease of the residual amount. Thus, the residual amount may be determined by the above measurement.

The residual amount is suitably 0.2 part by weight or less, preferably 0.1 part by weight or less, more preferably 0.05 part by weight or less, most preferably 0.01 part by weight or less, per part by weight of the resin in the thermosensitive layer.

The above measurement may also permits the determination of the residual amount of the photopolymerization initiator and photosensitizer used in the UV curing stage and the catalyst used in the thermal curing stage. Thus by the qualitative analysis of the residual components, it is possible to determine which method has been adopted in among the EB curing, UV curing and thermal curing. In any method, the durability is improved as the residual component decreases.

With the above measuring method, information of only the thin layer of the order of several μm at the surface of the coating is given. Thus, the thermosensitive layer formed on the support may be measured as such.

Besides, when a space, which has a refraction index different from that of the resin or the organic low molecular weight material particles in the thermosensitive layer, is present in the interface between the resin and the particles and/or within the particles, the image density of the white opaqueness is improved and, thus, the contrast is improved. This effect is more significant when the size of the space is 1/10 or more of the wavelength of the light used for detecting the opaqueness.

When the image formed on the reversible thermosensitive recording material of the present invention is observed as a reflection type image, it is preferred that a light reflection layer be provided behind the recording layer. The reflection layer can increase the contrast even when the thickness of the recording layer is thin. Specifically, the reflection layer may be formed by deposition of Al, Ni, Sn or the like metal as described in JP-A-64-14079.

A protective layer may be formed on the recording layer for protecting same. As the material for the protective layer (thickness: 0.1–10 μm), silicone rubber, silicone resin (JP-A-63-221087), polysiloxane graft polymer (Japanese patent application No. 63-317385), ultraviolet radiation-curable resin or electron beam-curable resin (Japanese patent application No. 2-566) may be employed. In any case, a solvent is used for coating the protective layer. It is desired that the solvent used be such that the resin and the organic low molecular weight material of the recording layer are hardly soluble therein.

Examples of the solvents in which the resin and the organic low molecular weight material of the recording layer are hardly soluble therein include n-hexane, methanol, ethanol and isopropanol. In particular, the use of an alcohol-series solvent is desirable from the standpoint of the costs.

The protective layer may be cured simultaneously with the cross-linking of the resin of the recording layer. In this case, after the recording layer has been formed on the support in the manner previously described, the protective layer is applied and dried. Then the electron beam irradiation is performed using the above-described EB irradiation device and irradiation conditions for curing the both layers.

Further, an intermediate layer may be interposed between the protective layer and the recording layer to protect the recording layer from the solvent or a monomer component for the protective layer formation liquid (JP-A-1-133781). In addition to the resins exemplified as the resin matrix material for the recording layer, the following thermosetting resin and thermoplastic resins may be used as the material for the intermediate layer: polyethylene, polypropylene, polystyrene, polyvinyl alcohol, polyvinyl butyral, polyurethane, saturated polyester, unsaturated polyester, epoxy resin, phenolic resin, polycarbonate and polyamide. The intermediate layer preferably has a thickness of 0.1–2 μm.

As the layer construction of the reversible thermosensitive recording material of the present invention, there may be mentioned a construction in which, as disclosed in Japanese Laid-Open Utility Model Application No. 2-3876, a thermosensitive recording layer and a magnetic recording layer containing a magnetic material as a main ingredient thereof are provided on a support, at least the portion immediately below the thermosensitive recording layer or the portion of the support corresponding to the thermosensitive recording layer being colored.

Alternatively, there may be mentioned a construction in which a support is overlaid with a magnetic recording layer, a light reflection layer and a thermosensitive layer in this order. In this case, the magnetic recording layer may be provided either on the backside of the support or between the support and the thermosensitive layer. Other layer constructions may be used, if desired.

In the present invention, a color layer may be provided between the support and the recording layer to improve the visibility. The color layer may be formed by applying and drying a solution or a dispersion containing, as main ingredients, a coloring agent and a resin binder or by simply applying a color sheet. Any coloring agent may be used as long as it permits the recognition of changes between transparency and white opaqueness of the upper, recording layer as a reflected image. A dye or pigment of red, yellow, blue, dark blue, purple, black, brown, gray, orange or green may be used. The resin binder may be a thermoplastic, thermosetting or UV-curable resin.

An air layer of an air-containing non-adhesion portion may be interposed between the support and the recording layer. Since the index of refraction of the organic high molecular weight material used as a main ingredient of the recording layer is 1.4–1.6 and is quite different from that of air (1.0), light is reflected on the interface between the non-adhesion portion and the film on the thermosensitive recording layer side. Thus, the air layer serves to amplify the white opaqueness of the recording layer in the clouded state, so that the visibility is improved. It is therefore desirable to use the non-adhesion portion as a displaying section.

Since the non-adhesion portion, which contains air therewithin, serves as a heat insulating layer, the heat sensitivity is improved. Further, since the non-adhesion portion serves to function as a cushion, the pressure applied to the thermosensitive layer by the pressing with a thermal head is small, so that the recording layer is prevented from deforming and the particles of the organic low molecular weight material are prevented from expanding even when a heat is applied thereto. Thus, the durability in repeated use may be improved.

A layer of an adhesive or pressure-sensitive adhesive may be further provided on the backside of the support to form a reversible thermosensitive recording label. The label sheet is applied to a body to be mounted such as a vinyl chloride card (e.g. credit card), an IC card, an ID card, a paper, a film, a synthetic paper, a boarding card or a pass. The body to be mounted is not limited to the above specific examples. If desired, an adhesive layer may be interposed between the support and the thermosensitive layer (JP-A-3-7377), when the support is made of a material such as an aluminum deposit layer which is poor in adhesion to the resin.

Next, the method of forming and erasing an image according to the present invention will be described. There is one image forming and erasing method in which the common heat-generating member such as a thermal head is used as image forming and image erasing means for forming and erasing an image. In this case, the image processing is carried out by changing the energy applied to the thermal head. In another image forming and erasing method, a thermal head is used as the image forming means, while one of contact-pressing type means for contacting a heat generating body, such as a thermal head, a hot stamp, a heat roller or a heat block, or one of non-contact type means using hot air or infrared radiation is used as the image erasing means.

Specific examples of the image forming and erasing method are illustrated in FIGS. 11(*a*) through 11(*d*).

FIG. 11(*a*) schematically illustrates a contactpressing type heating device adapted to press a hot stamp 502 against a stationary reversible thermosensitive recording material 501, thereby to effect transparentization. Designated as 503 is a stamp base.

FIG. 11(*b*) schematically illustrates a contact-pressing type heating device having a heat roller 504 adapted to effect transparentization. Designated as 505 is an idle roller. In this device, the heat roller 504 and the idle roller 505 rotate at the same velocity and a reversible thermosensitive recording material 501 is nipped and displaced therebetween.

FIG. 11(*c*) schematically depicts a non-contact type heating device having a dryer 506 adapted to eject hot air to effect transparentization. Designated as 507 is a feed roller.

FIG. 11(*d*) schematically illustrates a contact-pressing type heating device having a heat block 508 adapted to effect transparentization. Designated as 507 is a feed roller. Although not illustrated in the accompanying drawings, it is without saying that a thermal head may be used as an image erasing device.

Specific examples of the image forming and erasing method for displaying an image according to the present invention will be described below.

Figure 12A:
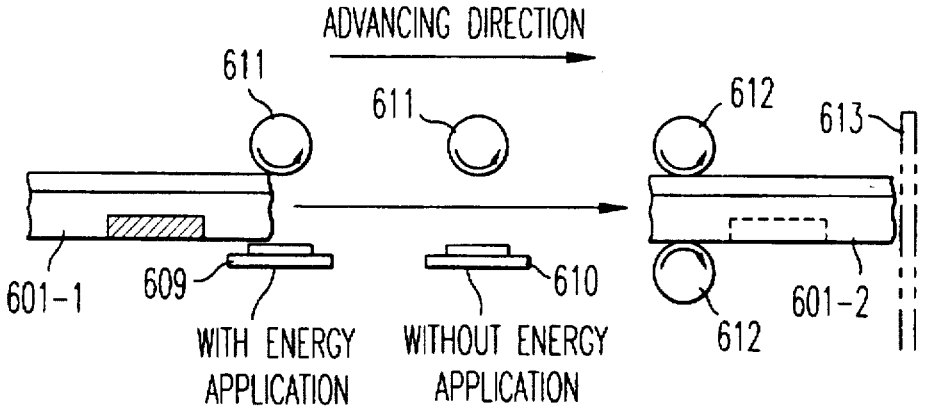
FIGS. 12(*a*) and 12(*b*) show an example of the formation and erasure of images on a reversible thermosensitive recording material using a thermal head according to a process of the present invention.
Figure 12B:
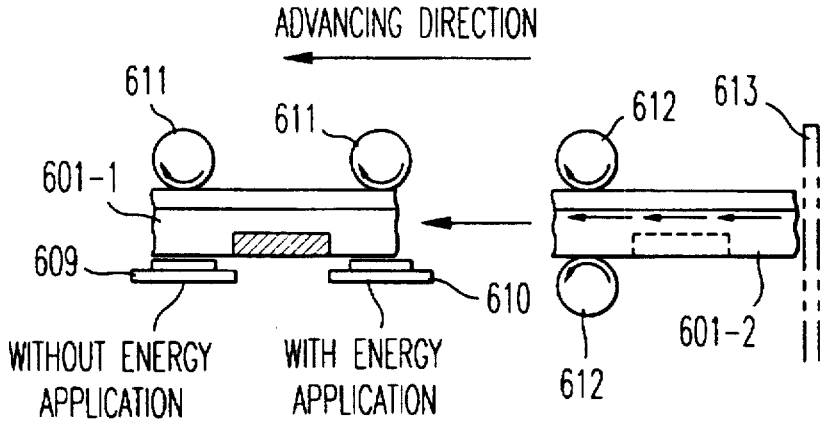

FIG. 12 illustrates an embodiment wherein thermal heads are used as the image forming and image erasing means for forming and erasing an image on the reversible thermosensitive recording material.

In FIG. 12(*a*), a reversible thermosensitive recording medium 601-1 having an image formed thereon is displaced rightward by a platen roll 601. During the displacement, an energy is applied by an image erasing thermal head 609 so that the image is erased. (At the same time, a shearing stress is exerted in the plane at which the recording material is contacted with the thermal head. The shearing stress is extremely small when the resin of the recording layer is cross-linked.)

At this point in time, no energy is applied from the image forming thermal head so that the recording material is fed by the platen rolls 611 and guide rolls 612 to a topper 613.

In FIG. 12(*b*), the reversible thermosensitive material 601-2 from which the image has been erased is fed leftward by the guide rolls 612 and thereafter by the platen rolls 611. In this case, an energy is applied from the image forming thermal head 610 so that an image is newly formed. (At the same time, a shearing stress is exerted in the plane at which the recording material is contacted with the thermal head. The shearing stress is extremely small as described previously.)

At this point in time, no energy is applied from the image erasing thermal head 609 so that the recording material is displaced leftward by the platen rolls 611.

The image display using the reversible thermosensitive recording material may be thus carried out by the foregoing image forming and erasing method.

In the above image forming and erasing method, the thermal heads 609 and 610 may be replaced by a single thermal head. Alternatively, the image erasing thermal head 609 may be substituted by contact-pressing type erasing device such as a hot stamp, a heat roller or a heat block or by non-contact type erasing device using hot air or infrared radiation. In the embodiment shown, the image erasing thermal head 609 and image forming thermal head 610 are provided. The arrangement of the thermal heads may be reversed if desired.

Figure 13:
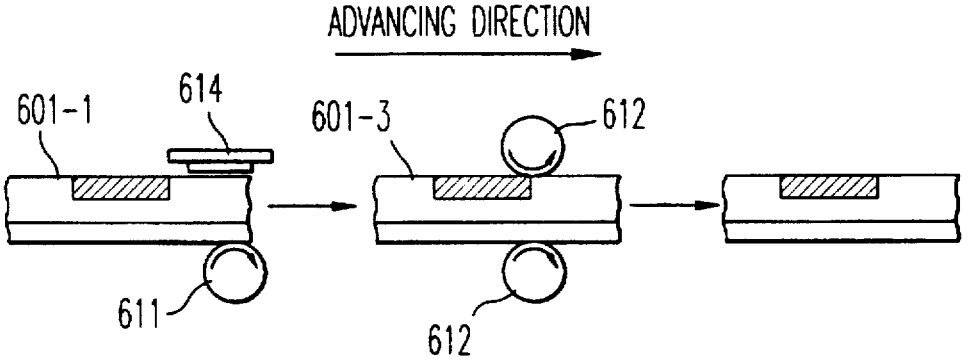
FIG. 13 shows an example of the formation and erasure of images on a reversible thermosensitive recording material using a thermal head together with a pressing means and a guide roller provided downstream of the thermal head.

Next, shown in FIG. 13 is an embodiment in which the common thermal head is used as the image forming and image erasing means for forming and erasing an image on the reversible thermosensitive recording material and in which guide rolls are disposed, as pressing means, downstream of the thermal head. In FIG. 13, the reversible thermosensitive recording material 601-1 bearing an image is displaced rightward by a platen roll 611. During this displacement, the image forming and erasing thermal head 614 operates so that the old image is erased and a new image is formed. The reversible recording material 601-3 bearing the new image is further displaced rightward by the platen roll 611 and passed rightward through the guide rolls 612.

The image display may be performed according to the foregoing image forming and erasing method. The formation and erasure of the image may be performed without contact, if desired. It is also possible to perform the following step between the steps of the image formation and image erasure: (1) heating the recording material at a temperature higher than the image forming temperature by a non-contact method or (2) heating the recording material at a temperature higher than the image forming temperature while applying a pressure.

In the reversible thermosensitive recording material of the present invention, when the recording layer as a whole has a cross-linked structure, the recording layer inclusive of the organic low molecular weight material is not distorted so that the erasure of the recording may be always suitably performed. The present invention will be described in more detail below by way of examples. Parts and percentages are by weight.

EXAMPLE 1

$\gamma$—$Fe_2O_3$ 10 parts

Vinyl chloride-vinyl acetate-vinyl alcohol copolymer (VAGH manufactured by UCC Inc.) 10 parts Isocyanate (COLONATE L manufactured by Nippon Polyurethane Inc., 50% toluene solution) 2 parts Methyl ethyl ketone 40 parts Toluene 40 parts The liquid having the above composition was coated on a white PET having a thickness of about 188 μm with a wire bar and dried with heating to form a magnetic recording layer having a thickness of about 10 μm.

Specific acrylic UV hardenable resin (UNIDEC C7-164 manufactured by Dai Nippon Ink Ltd., 49% butyl acetate solution) 10 parts Toluene 4 parts The above solution was coated on the thus formed magnetic recording layer with a wire bar, dried with heating and irradiated with UV radiation using a UV lamp of 80 W/cm to form a smooth layer having a thickness of about 1.5 μm. Aluminum was vacuum-deposited on the smooth layer to obtain a reflection layer with a thickness of about 400 Å.

Vinyl chloride-vinyl acetate-phosphoric acid ester copolymer (DENKA VINYL #1000P manufactured by Denki Kagaku Kogyo K. K.) 10 parts THF (tetradyrofuran) 90 parts The above solution was coated on the light reflection layer with a wire bar and dried with heating to obtain an adhesive layer with a thickness of about 0.5 μm.

Octadecyl stearate (M9676 manufactured by Nippon Yushi Inc.) 5 parts

Eicosanedioic acid (SL-20-99 manufactured by Okamura Seiyu Inc.) 5 parts

Diisodecyl phthalate 3 parts

Vinyl chloride-vinyl propionate copolymer (20-1834 manufactured by Kanegafuchi Kagaku Kogyo Inc., average polymerization degree: 500, vinyl chloride: 70%, vinyl propionate: 30%, trial manufacture product) 37 parts Trimethylolpropane triacrylate (TMP3A manufactured by Osaka Yuki Kagaku Inc.) 2 parts THF (tetrahydrofuran) 100 parts Toluene 65 parts The above solution was coated on the adhesive layer with a wire bar and dried with heating to obtain a thermosensitive layer (reversible thermosensitive recording layer) having a thickness of about 8 μm.

The recording layer was irradiated with an electron beam using an area beam-type electron beam irradiation device EBC-200-AA2 manufactured by Nisshin High Voltage Inc. The irradiation with electron beam was performed twice so that the total dose was 30 Mrad.

75% butyl acetate solution of urethane acrylate UV hardenable resin (UNIDIC C7-157 manufactured by Dai Nippon Ink Inc.) 10 parts Isopropanol 10 parts The above solution was coated on the hardened recording layer with a wire bar, dried with heating and irradiated with UV radiation using a UV lamp of 80 W/cm to form a protective layer having a thickness of about 2 μm, thereby obtaining a reversible thermosensitive recording material.

The above thermosensitive layer-forming solution was applied to a transparent PET having a thickness of about 188 μm serving as a support to form a thermosensitive layer in the same manner as above. After irradiation with an electron beam, the layer was peeled off from the support to obtain a thermosensitive film.

EXAMPLE 2

Example 1 was repeated in the same manner as described except that a vinyl chloride-vinyl propionate copolymer (20-1833 manufactured by Kanegafuchi Kagaku Kogyo Inc., average polymerization degree: 500, vinyl chloride: 80%, vinyl propionate: 20%, trial manufacture product) was used as the resin matrix of the thermosensitive layer, thereby obtaining a reversible thermosensitive recording material and a thermosensitive film.

EXAMPLE 3

Example 1 was repeated in the same manner as described except that a vinyl chloride-vinyl propionate copolymer (20-1832 manufactured by Kanegafuchi Kagaku Kogyo Inc., average polymerization degree: 500, vinyl chloride: 90%, vinyl propionate: 10%, trial manufacture product) was used as the resin matrix of the thermosensitive layer, thereby obtaining a reversible thermosensitive recording material and a thermosensitive film.

EXAMPLE 4

Example 1 was repeated in the same manner as described except that a vinyl chloride-vinyl propionate copolymer (L-AP manufactured by Kanegafuchi Kagaku Kogyo Inc., average polymerization degree: 345, vinyl chloride: 60%, vinyl propionate: 40%) was used as the resin matrix of the thermosensitive layer, thereby obtaining a reversible thermosensitive recording material and a thermosensitive film.

EXAMPLE 5

Example 1 was repeated in the same manner as described except that a vinyl chloride-vinyl propionate copolymer (L-AU manufactured by Kanegafuchi Kagaku Kogyo Inc., average polymerization degree: 185, vinyl chloride: 60%, vinyl propionate: 40%) was used as the resin matrix of the thermosensitive layer, thereby obtaining a reversible thermosensitive recording material and a thermosensitive film.

EXAMPLE 6

Example 1 was repeated in the same manner as described except that a vinyl chloride-ethylene copolymer (VE-S manufactured by Sekisui Kagaku Inc., average polymerization degree: 470, vinyl chloride: 92%, ethylene: 8%) was used as the resin matrix of the thermosensitive layer, thereby obtaining a reversible thermosensitive recording material and a thermosensitive film.

EXAMPLE 7

Example 6 was repeated in the same manner as described except that a vinyl chloride-ethylene copolymer (VE-U manufactured by Sekisui Kagaku Inc., average polymerization degree: 1,050, vinyl chloride: 92%, ethylene: 8%) was used as the resin matrix of the thermosensitive layer, thereby obtaining a reversible thermosensitive recording material and a thermosensitive film.

EXAMPLE 8

Example 6 was repeated in the same manner as described except that a vinyl chloride-ethylene copolymer (VE-R manufactured by Sekisui Kagaku Inc., average polymerization degree: 500, vinyl chloride: 96%, ethylene: 4%) was used as the resin matrix of the thermosensitive layer, thereby obtaining a reversible thermosensitive recording material and a thermosensitive film.

EXAMPLE 9

Example 6 was repeated in the same manner as described except that a vinyl chloride-ethylene copolymer (VE-L manufactured by Sekisui Kagaku Inc., average polymerization degree: 1,350, vinyl chloride: 96%, ethylene: 4%) was used as the resin matrix of the thermosensitive layer, thereby obtaining a reversible thermosensitive recording material and a thermosensitive film.

EXAMPLE 10

Example 1 was repeated in the same manner as described except that the trimethylolpropane triacrylate was not used at all and that the irradiation with electron beam was not performed, thereby obtaining a reversible thermosensitive recording material and a thermosensitive film.

EXAMPLE 11

Example 6 was repeated in the same manner as described except that the trimethylolpropane triacrylate was not used at all and that the irradiation with electron beam was not performed, thereby obtaining a reversible thermosensitive recording material and a thermosensitive film.

EXAMPLE 12

Example 1 was repeated in the same manner as described except that a vinyl chloride-vinyl butylate copolymer (manufactured by Kanegafuchi Kagaku Inc., average polymerization degree: 500, vinyl chloride: 80%, vinyl butylate: 20%, trial manufacture product) was used as the resin matrix of the thermosensitive layer, thereby obtaining a reversible thermosensitive recording material and a thermosensitive film.

EXAMPLE 13

Example 12 was repeated in the same manner as described except that the trimethylolpropane triacrylate was not used at all and that the irradiation with electron beam was not performed, thereby obtaining a reversible thermosensitive recording material and a thermosensitive film.

COMPARATIVE EXAMPLE 1

Example 1 was repeated in the same manner as described except that a vinyl chloride-vinyl acetate copolymer (20–1796 manufactured by Kanegafuchi Kagaku Inc., average polymerization degree: 3,000, vinyl chloride: 80%, vinyl acetate: 20%) was used as the resin matrix of the thermosensitive layer, thereby obtaining a reversible thermosensitive recording material and a thermosensitive film.

COMPARATIVE EXAMPLE 2

Comparative Example 1 was repeated in the same manner as described except that the trimethylolpropane triacrylate was not used at all and that the irradiation with electron beam was not performed, thereby obtaining a reversible thermosensitive recording material and a thermosensitive film.

The thus obtained reversible thermosensitive recording materials and thermosensitive films of Examples and Comparative Examples were measured for their properties given below and the results are shown in Tables 1–5.

Measurement of Rate of Change of Heating Temperature for the Initiation of Transparentization:

The reversible thermosensitive recording material was subjected to the measurement of transparentization initiation temperature ($T_{60S}$) at heating time of 60 seconds using the previously described device. Then, the printing timer was set to 1 second and the transparentization initiation temperature ($T_{1S}$) at heating time of 1 second is measured in the same manner. From the thus obtained values of $T_{60S}$ and $T_{1S}$, the rate of change of heating temperature for initiating transparentization was calculated. The results are shown in Table 1.

Measurement of Temperature Range for Tranaparentization:

The heating temperature used for measuring the above heating temperature for the initiation of transparentization was extended to a higher temperature. The reflection density at respective heating temperatures was measured with Macbeath densitometer. The heating temperature at which the reflection density is decreased to (d–0.2) O. D., where d stands for the density of background density, represents a transparentization completion temperature. The transparentization completion temperatures at heating time of 60 seconds ($T_{60L}$) and 1 second ($T_{1L}$) were measured. From the transparentization initiation and termination temperatures $T_{60S}$, $T_{1S}$, $T_{60L}$ and $T_{1L}$, the temperature range for transparentization temperature at each heating time was calculated. The results are shown in Table 2.

Measurement of Rate of Change of Transparency:

Each of the thermosensitive film was heated and then cooled such that the film showed the maximum white opaque state and maximum transparent state, thereby obtaining two kinds of films in the maximum white opaque state and maximum transparent state.

Using the device for measuring the rate of change in transparency as shown in FIG. 2, the transmitted light intensity in static transparency ($V_{ST}$), the transmitted light intensity in static white opaqueness ($V_{SW}$), the transmitted light intensity in dynamic white opaqueness ($V_{DW}$) and the transmitted light intensity in dynamic transparency ($V_{DT}$) were measured. From the thus obtained intensities of the transmitted light $V_{SW}$, $V_{ST}$, $V_{DW}$ and $V_{DT}$, the rate of change in transparency was calculated. The results are shown in Table 3.

Figure 14A:
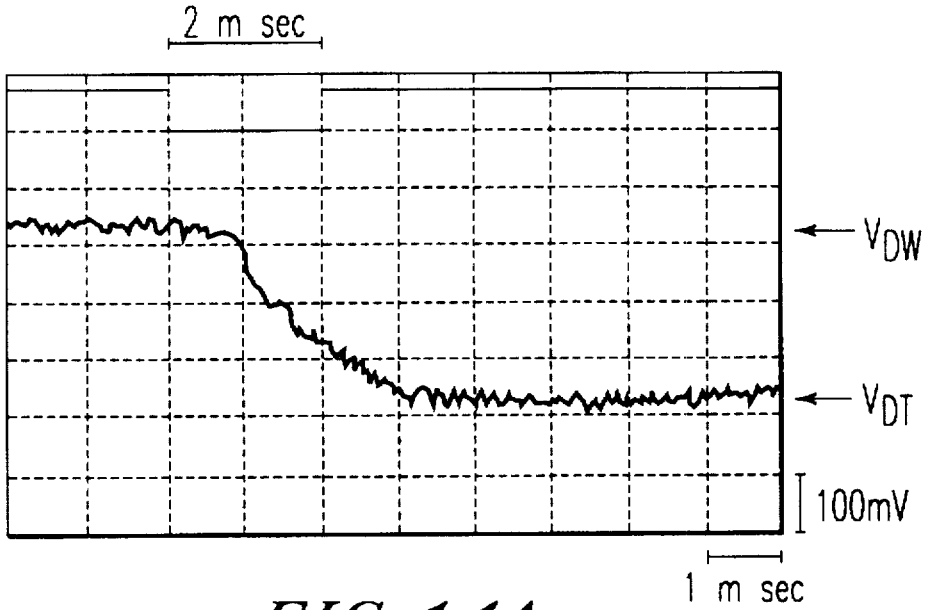
FIG. 14 (*a*) is a diagram showing a wave form of the intensity of transmitted light outputted from a printer of a digital oscilloscope of a thermosensitive layer film obtained in Example 1.
Figure 14B:
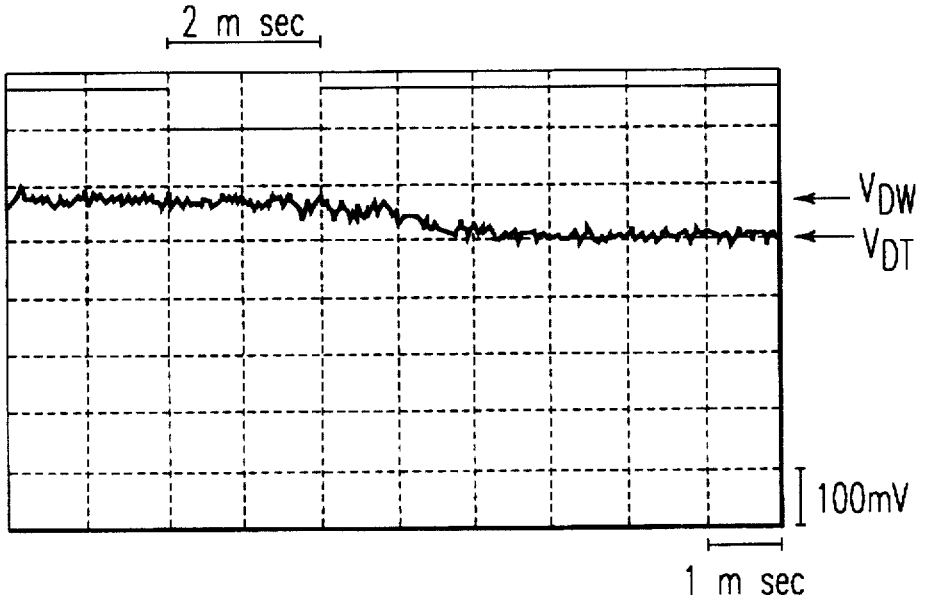

The transmitted light intensity wave forms outputted from the printer of the digital oscilloscope in the measurement of the transmitted light intensity in dynamic transparency of the recording material of Example 1 and Comparative Example 1 are shown in FIG. 14.

Measurement of Rate of Change in Film Thickness:

The thermosensitive film in the maximum white opaque state used in the above measurement of the rate of change in transparency was measured for the thickness thereof under the previously described conditions. An average value was then calculated to obtain a film thickness of the thermosensitive layer in the white opaque state ($R_W$). The film was then heated in a constant temperature oven and cooled such that the film showed the maximum transparency. A film thickness was measured and an average value was calculated in the same manner as above to obtain a film thickness of the thermosensitive layer in the transparent state ($R_T$).

From the thickness $R_W$ and $R_T$ and the above-described rate of change in transparency ($C_T$%), the rate of change in film thickness was calculated to give the results shown in Table 4.

The recording materials of Examples and Comparative Examples are subjected to durability test in image formation and erasure. The results are shown in Table 5.

Initial White Opaque Image Density:

As a thermosensitive recording device, a print testing device manufactured by Yashiro Electric Inc. having a thermal head KBD-40-8MGK1 manufactured by Kyocera Inc. was used. White opaque images were formed at a pulse width of 2.0 milliseconds and an applied voltage of 12.5 V. The density of the white opaque images is the initial white opaque image density. The smaller the value, the higher the whiteness.

Figure 15:
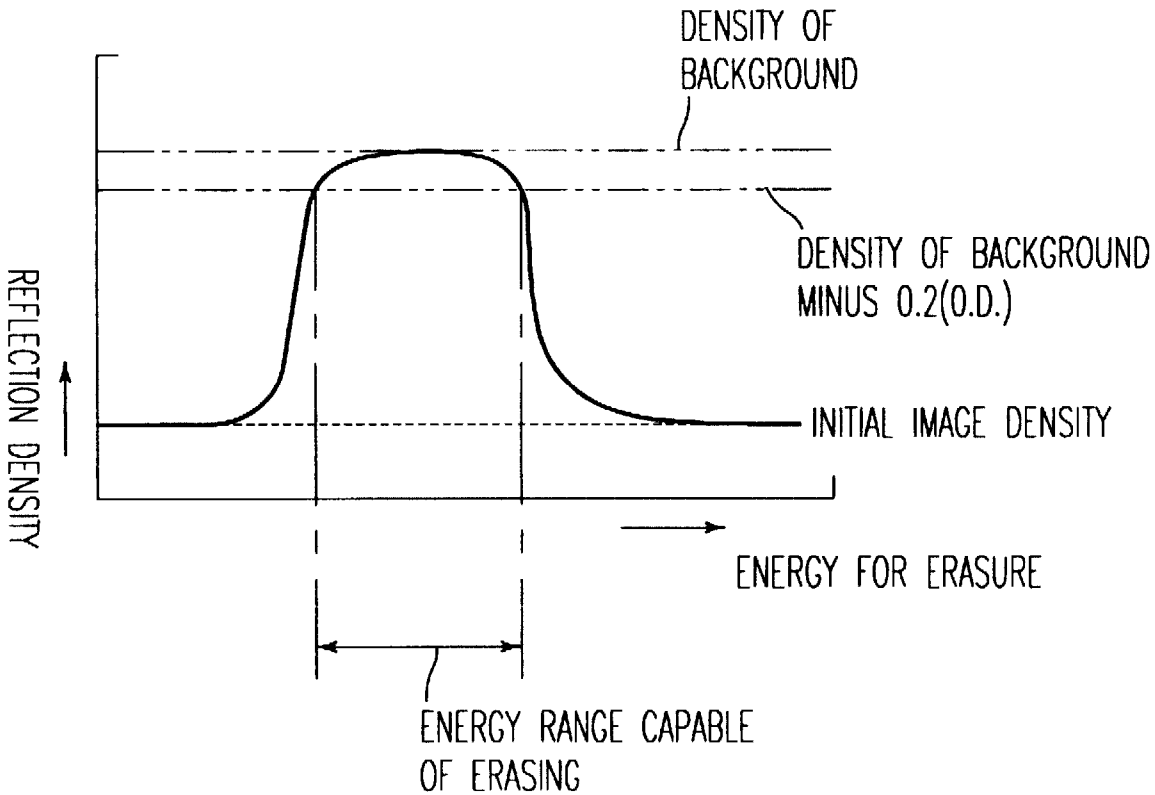
FIG. 15 is a graph showing a relationship between the erasing energy and the erased image density.

Erasability:

White opaque images were formed under the same conditions as above density measurement. The applied voltage was then immediately changed to effect transparentization. As shown in FIG. 15, the density after the erasure is plotted against the erasing energy to determine the range of energy capable of erasing the image. The density of that portion at which the transparency became maximum was determined as density of maximum transparency. The difference between the density of maximum transparency and the background density represents initial erasability.

After forming a white opaque image, the recording material was stored at 23° C. and 40° C. for 24 hours. The image was then erased in the same manner as the initial stage to obtain the range of energy capable of erasing the image after storage. Also determined was a range of energy capable of erasing the image which range was common to the initial stage and after storage. The difference between the density of the background density and the density of that portion at which the initial erasability was determined represents erasability after storage.

Durability in Repeated Operations:

The formation of white images and transparentization thereof were repeated. The density of the white opaque image at the 40th image formation was measured. The difference between the initial density of the white opaque image and the density of the image in the 40th image formation represents the durability in repeated operations.

TABLE 1

| Example | $T_{60S}$ (°C.) | $T_{1S}$ (°C.) | Transparency Change *1 (%) |
|---|---|---|---|
| 1 | 58 | 59 | 1.7 |
| 2 | 59 | 61 | 3.4 |
| 3 | 59 | 61 | 3.4 |
| 4 | 56 | 57 | 1.8 |
| 5 | 56 | 58 | 3.6 |
| 6 | 59 | 63 | 6.8 |
| 7 | 60 | 64 | 6.7 |
| 8 | 62 | 69 | 11.3 |
| 9 | 63 | 69 | 9.5 |
| 10 | 59 | 60 | 1.7 |
| 11 | 59 | 63 | 6.8 |
| 12 | 56 | 57 | 1.8 |
| 13 | 57 | 58 | 1.8 |
| Comp. 1 | 68 | 78 | 14.7 |
| Comp. 2 | 67 | 77 | 14.9 |

*1: Rate of change of heating temperature for initiating transparentization

TABLE 2

| Example | $T_{60L}$ (°C.) | Temperature Range (°C.) *1 | $T_{1L}$ (°C.) | Temperature Range (°C.) *2 |
|---|---|---|---|---|
| 1 | 118 | 60 | 121 | 62 |
| 2 | 119 | 61 | 121 | 60 |
| 3 | 117 | 60 | 122 | 60 |
| 4 | 118 | 62 | 119 | 62 |
| 5 | 117 | 61 | 120 | 62 |
| 6 | 114 | 57 | 116 | 56 |
| 7 | 110 | 55 | 117 | 55 |
| 8 | 115 | 55 | 118 | 54 |
| 9 | 114 | 52 | 117 | 52 |
| 10 | 117 | 58 | 119 | 59 |
| 11 | 114 | 55 | 115 | 53 |
| 12 | 116 | 60 | 118 | 61 |
| 13 | 115 | 58 | 118 | 60 |
| Comp. 1 | 110 | 44 | 121 | 43 |
| Comp. 2 | 107 | 42 | 120 | 43 |

*1: Temperature range for transparentization at a heating time of 60 seconds
*2: Temperature range for transparentization at a heating time of 1 second

TABLE 3

| Example | $V_{SW}$ (mV) | $V_{ST}$ (mV) | $V_{DW}$ (mV) | $V_{DT}$ (mV) | Transparency Change CT (%) *1 |
|---|---|---|---|---|---|
| 1 | 550 | 240 | 530 | 240 | 94 |
| 2 | 550 | 250 | 540 | 260 | 93 |
| 3 | 540 | 250 | 540 | 270 | 93 |
| 4 | 530 | 240 | 530 | 250 | 97 |
| 5 | 540 | 250 | 540 | 260 | 97 |
| 6 | 520 | 240 | 520 | 300 | 79 |
| 7 | 500 | 230 | 500 | 290 | 78 |
| 8 | 530 | 240 | 520 | 360 | 55 |
| 9 | 520 | 240 | 500 | 320 | 64 |
| 10 | 530 | 250 | 520 | 250 | 96 |
| 11 | 510 | 240 | 510 | 290 | 81 |
| 12 | 540 | 250 | 530 | 250 | 97 |
| 13 | 530 | 250 | 520 | 250 | 96 |
| Comp. 1 | 550 | 300 | 580 | 480 | 40 |
| Comp. 2 | 540 | 300 | 570 | 460 | 46 |

*1: Rate of change in transparency

TABLE 4

| Example | $R_W$ (μm) | $R_T$ (μm) | $C_T$ (%) | Thickness Change *1 (%) |
|---|---|---|---|---|
| 1 | 8.5 | 8.0 | 94 | 5.5 |
| 2 | 8.5 | 8.1 | 93 | 4.4 |
| 3 | 8.4 | 8.0 | 93 | 4.4 |
| 4 | 8.6 | 8.1 | 97 | 5.6 |
| 5 | 8.5 | 8.0 | 97 | 5.7 |
| 6 | 8.4 | 8.0 | 79 | 3.8 |
| 7 | 8.5 | 8.1 | 78 | 3.7 |
| 8 | 8.6 | 8.2 | 55 | 2.6 |
| 9 | 8.5 | 8.2 | 64 | 2.3 |
| 10 | 8.6 | 8.1 | 96 | 5.6 |
| 11 | 8.5 | 8.1 | 81 | 3.8 |
| 12 | 8.4 | 7.9 | 97 | 5.8 |
| 13 | 8.5 | 8.0 | 96 | 5.6 |
| Comp. 1 | 8.4 | 8.1 | 40 | 1.4 |
| Comp. 2 | 8.4 | 8.1 | 46 | 1.6 |

*1: Rate of change in film thickness

TABLE 5a

| | | | Erasability (Initial) | |
|---|---|---|---|---|
| Example | Initial Density *1 | Dura-ability *2 | Initial Erasability | Energy Range *3 |
| 1 | 0.45 | 0.11 | 0.04 | 0.03 |
| 2 | 0.47 | 0.09 | 0.03 | 0.08 |
| 3 | 0.47 | 0.08 | 0.04 | 0.08 |
| 4 | 0.45 | 0.12 | 0.02 | 0.03 |
| 5 | 0.48 | 0.08 | 0.01 | 0.09 |
| 6 | 0.51 | 0.12 | 0.08 | 0.06 |
| 7 | 0.55 | 0.09 | 0.04 | 0.06 |
| 8 | 0.52 | 0.11 | 0.06 | 0.05 |
| 9 | 0.54 | 0.08 | 0.05 | 0.05 |
| 10 | 0.48 | 0.23 | 0.06 | 0.08 |
| 11 | 0.48 | 0.21 | 0.06 | 0.05 |
| 12 | 0.48 | 0.12 | 0.02 | 0.09 |
| 13 | 0.47 | 0.25 | 0.03 | 0.08 |
| Comp. 1 | 0.53 | 0.09 | 0.14 | 0.03 |
| Comp. 2 | 0.54 | 0.20 | 0.15 | 0.03 |

*1: Initial white opaque image density
*2: Durability in repeated operations
*3: Initial range of energy for erasure (mj/dot)

TABLE 5b

| | Erasability (After 23° C. × 24 hours) | | |
|---|---|---|---|
| Example | Erasability *1 | Energy Range *2 | Common Range *3 |
| 1 | 0.03 | 0.10 | 0.09 |
| 2 | 0.01 | 0.08 | 0.08 |
| 3 | 0.02 | 0.08 | 0.07 |
| 4 | 0.02 | 0.09 | 0.09 |
| 5 | 0.01 | 0.09 | 0.09 |
| 6 | 0.04 | 0.06 | 0.06 |
| 7 | 0.03 | 0.06 | 0.06 |
| 8 | 0.05 | 0.06 | 0.05 |
| 9 | 0.04 | 0.05 | 0.05 |
| 10 | 0.05 | 0.08 | 0.07 |
| 11 | 0.05 | 0.05 | 0.05 |
| 12 | 0.02 | 0.09 | 0.09 |
| 13 | 0.04 | 0.08 | 0.08 |
| Comp. 1 | 0.19 | 0.02 | 0.02 |
| Comp. 2 | 0.21 | 0.02 | 0.02 |

*1: Erasability after storage
*2: Range of energy for erasure (mj/dot)
*3: Common range of energy for erasure (mj/dot)

TABLE 5c

| Example | Erasability (After 40° C. × 24 hours) | | |
|---|---|---|---|
| | Erasability *1 | Energy Range *2 | Common Range *3 |
| 1 | 0.03 | 0.09 | 0.09 |
| 2 | 0.03 | 0.08 | 0.08 |
| 3 | 0.02 | 0.08 | 0.07 |
| 4 | 0.02 | 0.09 | 0.08 |
| 5 | 0.02 | 0.10 | 0.09 |
| 6 | 0.05 | 0.07 | 0.06 |
| 7 | 0.04 | 0.07 | 0.06 |
| 8 | 0.06 | 0.06 | 0.05 |
| 9 | 0.06 | 0.05 | 0.05 |
| 10 | 0.04 | 0.08 | 0.08 |
| 11 | 0.06 | 0.06 | 0.05 |
| 12 | 0.02 | 0.09 | 0.08 |
| 13 | 0.03 | 0.08 | 0.08 |
| Comp. 1 | 0.25 | 0.02 | 0.02 |
| Comp. 2 | 0.27 | 0.02 | 0.02 |

*1: Erasability after storage
*2: Range of energy for erasure (mj/dot)
*3: Common range of energy for erasure (mj/dot)

As will be apparent from the above description in the examples, the reversible thermosensitive recording material of the present invention has a rate of change in heating temperature for initiating transparentization is 13% or less, a temperature range for transparentization of 50° C. or more, a rate of change in transparency of the thermosensitive layer of 50% or more, and a rate of change in film thickness of the thermosensitive layer of 2% or more. Therefore, the recording layer shows improved high speed erasure characteristics, improved image erasability with a thermal head, improved erasability after lapse of time, and improved erasability after storage at different temperatures. By using at least one of a copolymer of vinyl chloride with a vinyl ester of a fatty acid having at least 3 carbon atoms and a copolymer of vinyl chloride with ethylene as a resin matrix constituting the thermosensitive layer, the above effects are further improved. Additionally, by using a specific organic low molecular weight material constituting the thermosensitive layer, the above effects are further improved. Furthermore, by cross-linking the thermosensitive layer of the recording material, the durability in repeated operations can be improved.

The method of forming and erasing images according to the present invention, in which the above reversible thermosensitive recording material is used, does not require a fine control of thermal head so that the formation and erasure of images can be performed at a high speed.

We claim:

1. A reversible thermosensitive recording material comprising a support, and a thermosensitive layer provided on said support and including, as main ingredients, a resin matrix which has a low softening point which is greater than the crystallization point of the below-defined organic low molecular weight material and an organic low molecular weight substance which is particulate dispersed in said resin matrix, wherein the transparency of said thermosensitive layer reversibly changes depending on the temperature thereof, characterized in that said reversible thermosensitive recording material has a rate of change in heating temperature for the initiation of transparentization of 13% or less.

2. A reversible thermosensitive recording material as claimed in claim 1, wherein said reversible thermosensitive recording material has a rate of change in heating temperature for the initiation of clarification of 10% or less.

3. A reversible thermosensitive recording material as claimed in claim 1, wherein said reversible thermosensitive recording material has a temperature range for transparentization of at least 50° C.

4. A reversible thermosensitive recording material as claimed in claim 1, characterized in that said resin matrix is at least one member selected from copolymers of vinyl chloride with a vinyl ester of a fatty acid having at least 3 carbon atoms and copolymers of vinyl chloride with ethylene.

5. A reversible thermosensitive recording material as claimed in claim 4, characterized in that said resin matrix is at least one member selected from vinyl chloride-vinyl propionate copolymers, vinyl chloride-vinyl butyrate copolymers and vinyl chloride-vinyl valerate copolymers.

6. A reversible thermosensitive recording material as claimed in claim 4, characterized in that said resin of said thermosensitive layer is cross-linked.

7. A reversible thermosensitive recording material as claimed in claim 6, wherein said resin is cross-linked with a cross-linking agent.

8. A reversible thermosensitive recording material as claimed in claim 7, wherein said resin is cross-linked by irradiation with an electron beam, by irradiation with a UV ray or by heating.

9. A reversible thermosensitive recording material as claimed in claim 1, characterized in that said thermosensitive layer has a level difference caused by heat and pressure of 40% or less.

10. A reversible thermosensitive recording material as claimed in claim 1, characterized in that said thermosensitive layer has a rate of change in level difference caused by heat and pressure of 70% or less.

11. A reversible thermosensitive recording material as claimed in claim 1, characterized in that said resin of said thermosensitive layer is cross-linked and has a rate of change in gel fraction of 110% or less.

12. A reversible thermosensitive recording material as claimed in claim 11, characterized in that said resin has a gel fraction of at least 30%.

13. A reversible thermosensitive recording material as claimed in claim 1, characterized in that said organic low molecular weight substance is a mixture of at least one low melting point organic low molecular weight compound with at least one high melting point organic low molecular weight compound.

14. A reversible thermosensitive recording material as claimed in claim 13, characterized in that the difference in melting point between said low melting point organic low molecular weight compound and said high melting point organic low molecular weight compound is at least 20° C.

15. A reversible thermosensitive recording material as claimed in claim 14, characterized in that said low melting point organic low molecular weight compound has a melting point of lower than 100° C. but not lower than 40° C.

16. A reversible thermosensitive recording material as claimed in claim 13, characterized in that said high melting point organic low molecular weight compound has a melting point of at least 100° C.

17. A reversible thermosensitive recording material comprising a support, and a thermosensitive layer provided on said support and including, as main ingredients, a resin matrix which has a low softening point which is greater than the crystallization point of the below-defined organic low molecular weight material and an organic low molecular weight substance which is particulate dispersed in said resin matrix, wherein the transparency of said thermosensitive layer reversibly changes depending on the temperature thereof, characterized in that said thermosensitive layer has a rate of change in transparency of at least 50%.

18. A reversible thermosensitive recording material as claimed in claim 17, wherein said thermosensitive layer has a rate of change in transparency of at least 60%.

19. A reversible thermosensitive recording material as claimed in claim 7, characterized in that said resin matrix is at least one member selected from copolymers of vinyl chloride with a vinyl ester of a fatty acid having at least 3 carbon atoms and copolymers of vinyl chloride with ethylene.

20. A reversible thermosensitive recording material as claimed in claim 19, characterized in that said resin matrix is at least one member selected from vinyl chloride-vinyl propionate copolymers, vinyl chloride-vinyl butyrate copolymers and vinyl chloride vinyl valerate copolymers.

21. A reversible thermosensitive recording material as claimed in claim 19, characterized in that said resin of said thermosensitive layer is cross-linked.

22. A reversible thermosensitive recording material as claimed in claim 21, wherein said resin is cross-linked with a cross-linking agent.

23. A reversible thermosensitive recording material as claimed in claim 22, wherein said resin is cross-linked by irradiation with an electron beam, by irradiation with a UV ray or by heating.

24. A reversible thermosensitive recording material as claimed in claim 17, characterized in that said thermosensitive layer has a level difference caused by heat and pressure of 40% or less.

25. A reversible thermosensitive recording material as claimed in claim 17, characterized in that said thermosensitive layer has a rate of change in level difference caused by heat and pressure of 70% or less.

26. A reversible thermosensitive recording material as claimed in claim 17, characterized in that said resin of said thermosensitive layer is cross-linked and has a rate of change in gel fraction of 110% or less.

27. A reversible thermosensitive recording material as claimed in claim 26, characterized in that said resin has a gel fraction of at least 30%.

28. A reversible thermosensitive recording material as claimed in claim 17, characterized in that said low melting point organic low molecular weight compound has a melting point of lower than 100° C. but not lower than 40° C.

29. A reversible thermosensitive recording material as claimed in claim 17, characterized in that said high melting point-organic low molecular-weight compound has a melting point of at least 100° C.

30. A reversible thermosensitive recording material comprising a support, and a thermosensitive layer provided on said support and including, as main ingredients, a resin matrix which has a low softening point which is greater than the crystallization point of the below-defined organic low molecular weight material and an organic low molecular weight substance which is particulate dispersed in said resin matrix, wherein the transparency of said thermosensitive layer reversibly changes depending on the temperature thereof, characterized in that said thermosensitive layer has a rate of change in film thickness of at least 2%.

31. A reversible thermosensitive recording material as claimed in claim 30, characterized in that said resin matrix is at least one member selected from copolymers of vinyl chloride with a vinyl ester of a fatty acid having at least 3 carbon atoms and copolymers of vinyl chloride with ethylene.

32. A reversible thermosensitive recording material as claimed in claim 31, characterized in that said resin matrix is at least one member selected from vinyl chloride-vinyl propionate copolymers, vinyl chloride-vinyl butyrate copolymers and vinyl chloridevinyl valerate copolymers.

33. A reversible thermosensitive recording material as claimed in claim 31, characterized in that said resin of said thermosensitive layer is cross-linked.

34. A reversible thermosensitive recording material as claimed in claim 33, wherein said resin is cross-linked with a cross-linking agent.

35. A reversible thermosensitive recording material as claimed in claim 37, wherein said resin is cross-linked by irradiation with an electron beam, by irradiation with a LTV ray or by heating.

36. A reversible thermosensitive recording material as claimed in claim 10, characterized in that said thermosensitive layer has a level difference caused by heat and pressure of 40% or less.

37. A reversible thermosensitive recording material as claimed in claim 30, characterized in that said thermosensitive layer has a rate of change in level difference caused by heat and pressure of 70% or less.

38. A reversible thermosensitive recording material as claimed in claim 30, characterized in that said resin of said thermosensitive layer is cross-linked and has a rate of change in gel fraction of 110% or less.

39. A reversible thermosensitive recording material as claimed in claim 38, characterized in that said resin has a gel fraction of at least 30%.

40. A reversible thermosensitive recording material as claimed in claim 30, characterized in that said low melting point organic low molecular weight compound has a melting point of lower than 100° C. but not lower than 40° C.

41. A reversible thermosensitive recording material as claimed in claim 30, characterized in that said high melting point organic low molecular weight compound has a melting point of at least 100° C.

42. A method of forming and erasing an image on a reversible thermosensitive recording material which has a rate of change in heating temperature for the initiation of transparentization of 13% or less and which includes a support, and a thermosensitive layer provided on said support and including, as main ingredients, a resin matrix which has a low softening point which is greater than the crystallization point of the below-defined organic low molecular weight material and an organic low molecular weight substance which is particulate dispersed in said resin matrix, wherein the transparency of said thermosensitive layer reversibly changes depending on the temperature thereof, characterized in that the formation of a white opaque image and/or the erasure of the white opaque image is carried out by heating.

43. A method of forming and erasing an image as claimed in claim 42, wherein said heating is performed with a thermal head.

44. A method of forming and erasing an image as claimed in claim 42, wherein the erasure of the white opaque image is performed with a thermal head.

45. A method of forming and erasing an image characterized in that a reversible thermosensitive recording material which has a rate of change in transparency of at least 50% and which includes a support, and a thermosensitive layer provided on said support and including, as main ingredients, a resin matrix which has a low softening point which is greater than the crystallization point of the below-defined organic low molecular weight material and an organic low molecular weight substance which is particulate dispersed in said resin matrix is heated for the formation of a white opaque image and/or for the erasure of the white opaque image, wherein the transparency of said thermosensitive layer reversibly changes depending on the temperature thereof.

46. A method of forming and erasing an image as claimed in claim 45, wherein said heating is performed with a thermal head.

47. A method of forming and erasing an image as claimed in claim 45, wherein the erasure of the white opaque image is performed with a thermal head.

48. A method of forming and erasing an image on a reversible thermosensitive recording material which has a rate of change in film thickness of at least 2% and which includes a support, and a thermosensitive layer provided on said support and including, as main ingredients, a resin matrix which has a low softening point which is greater than the crystallization point of the below-defined organic low molecular weight material and an organic low molecular weight substance which is particulate dispersed in said resin matrix, wherein the transparency of said thermosensitive layer reversibly changes depending on the temperature thereof, characterized in that the formation of a white opaque image and/or the erasure of the white opaque image is performed by heating.

49. A method of forming and erasing an image as claimed in claim 48, wherein said heating is performed with a thermal head.

50. A method of forming and erasing an image as claimed in claim 48, wherein the erasure of the white opaque image is performed with a thermal head.

51. A reversible thermosensitive recording material comprising a support, and a thermosensitive layer provided on said support and including, as main ingredients, a resin matrix which has a low softening point which is greater than the crystallization point of the below-defined organic low molecular weight material and an organic low molecular weight substance which is particulate dispersed in said resin matrix, wherein the transparency of said thermosensitive layer reversibly changes depending on the temperature thereof, characterized in that said resin matrix is at least one member selected from the group consisting of copolymers of vinyl chloride with a vinyl ester of a fatty acid having at least three carbon atoms and copolymers of vinyl chloride with ethylene.

52. A reversible thermosensitive recording material as claimed in claim 51, wherein said resin matrix is at least one member selected from the group consisting of vinyl chloride-vinyl propionate copolymers, vinyl chloride-vinyl butyrate copolymers and vinyl chloride-vinyl valerate copolymers.

* * * * *

UNITED STATES PATENT AND TRADEMARK OFFICE

CERTIFICATE OF CORRECTION

PATENT NO. : 5,747,413
DATED : May 5, 1998
INVENTOR(S) : Tetsuya Amano et al.

It is certified that error appears in the above-identified patent and that said Letters Patent is hereby corrected as shown below:

Column 3,
Line 42, "illustrate" should read -- illustrates --.

Column 4,
Line 40, "To" should read -- $T_0$ --.

Column 12,
Line 64, "when other layer" should read -- when the other layer --.

Column 13,
Line 19, "is formed a surface treated PET" should read -- is formed on a surface treated PET --;
Line 26, "second" should read -- seconds --;
Line 56, "no such a strain" should read -- no such strain --.

Column 14,
Line 21, "has found" should read -- have found --.

Column 15,
Line 5, "by use a cross-linked" should read -- by use of a cross linked --;
Line 7, "maintain" should read -- maintaining --;

Column 17,
Line 45, "mixtures" should read -- mixture --.

Column 18,
Line 61, "  " should read --  --.

Column 19,
Line 43, "broadening" should read -- broaden --.

Column 20,
Line 19, "by the method disclosed" should read -- the method disclosed --.

Column 25,
Line 45, "$CH_2$-C-$CH_3$" should read -- $CH_3$-C-$CH_3$ --.

UNITED STATES PATENT AND TRADEMARK OFFICE

CERTIFICATE OF CORRECTION

PATENT NO. : 5,747,413
DATED : May 5, 1998
INVENTOR(S) : Tetsuya Amano et al.

It is certified that error appears in the above-identified patent and that said Letters Patent is hereby corrected as shown below:

Column 26,
Line 56, "serves" should read -- serve --.

Column 27,
Line 14, "may generally divided" should read -- may generally be divided --.

Column 28,
Line 66, "permits" should read -- permit --.

Column 29,
Line 51, "for curing the both layers" should read -- for curing both layers --.

Column 35,
Line 47, "Tranaparentization" should read -- Transparentization --.

Column 40,
Line 50, "claim 14" should read -- claim 1 --.
Line 54, "claim 13" should read -- claim 1 --:

Column 41,
Line 5, "claim 7" should read -- claim 17 --.

Column 42,
Line 11, "LTV" should read -- UV --.
Line 14, "claim 10" should read -- claim 30 --.

Signed and Sealed this

Ninth Day of April, 2002

*Attest:*

*Attesting Officer*

JAMES E. ROGAN
*Director of the United States Patent and Trademark Office*